US008939290B2

(12) United States Patent
DeCello et al.

(10) Patent No.: US 8,939,290 B2
(45) Date of Patent: Jan. 27, 2015

(54) RETAIL READY CONTAINER

(75) Inventors: Thomas E. DeCello, York, PA (US); Troy M. Little, York, PA (US)

(73) Assignee: York Container Company, York, PA (US)

( * ) Notice: Subject to any disclaimer, the term of this patent is extended or adjusted under 35 U.S.C. 154(b) by 557 days.

(21) Appl. No.: 13/315,960

(22) Filed: Dec. 9, 2011

(65) Prior Publication Data

US 2013/0146504 A1 Jun. 13, 2013

(51) Int. Cl.
*B65D 5/52* (2006.01)

(52) U.S. Cl.
USPC ..... 206/774; 220/240; 220/238

(58) Field of Classification Search
CPC ..... B65D 17/55; B65D 5/00; B65D 5/18; B65D 5/44; B65D 5/52
USPC ..... 206/774; 229/240, 238
See application file for complete search history.

(56) References Cited

U.S. PATENT DOCUMENTS

| | | | | |
|---|---|---|---|---|
| 1,804,826 | A | 5/1931 | Einson | |
| 1,821,960 | A | 9/1931 | Brooks, Jr. | |
| 1,916,045 | A | 6/1933 | Freymann | |
| 1,925,102 | A * | 9/1933 | Levkoff | 206/746 |
| 1,942,537 | A | 1/1934 | Coleman | |
| 2,027,079 | A | 1/1936 | Weiss | |
| 2,131,391 | A | 9/1938 | Schraffenberger | |
| 2,536,990 | A | 1/1951 | Williamson | |
| 2,727,619 | A | 12/1955 | Paige | |
| 2,768,777 | A | 10/1956 | Barrington et al. | |
| 2,839,236 | A | 6/1958 | Dunning | |
| 3,863,829 | A | 2/1975 | Merrill | |
| 4,053,101 | A | 10/1977 | Hart, Jr. | |
| 4,382,504 | A | 5/1983 | Vesborg | |
| 4,413,726 | A | 11/1983 | Davidson | |
| 4,417,655 | A | 11/1983 | Forbes, Jr. | |
| 4,542,847 | A * | 9/1985 | Lindstrom | 206/766 |
| 4,736,837 | A | 4/1988 | Brainard | |
| 4,848,651 | A | 7/1989 | Hartness | |
| 4,909,410 | A | 3/1990 | Derby et al. | |
| 5,048,690 | A | 9/1991 | Zimmerman | |
| 5,462,220 | A | 10/1995 | Bacchetti et al. | |
| 5,503,324 | A | 4/1996 | Bacchetti et al. | |

(Continued)

FOREIGN PATENT DOCUMENTS

| | | |
|---|---|---|
| DE | 2108280 | 8/1972 |
| DE | 7237178 | 6/1973 |

(Continued)

*Primary Examiner* — Steven A. Reynolds
*Assistant Examiner* — King M Chu
(74) *Attorney, Agent, or Firm* — McNees Wallace & Nurick LLC

(57) ABSTRACT

A retail ready container is assembled from a single container blank having a container body portion and a protective cover portion. The container body portion includes a front container body panel, a left side container body panel and a right side container body panel. The protective cover portion includes a front cover panel, a left side cover panel and a right side cover panel. The left side cover panel is frangibly attached to the left side container body panel and the right side cover panel is frangibly attached to the right side container body panel. The container blank includes a finished side and an unfinished side. The container in the assembled state is configured so that the finished sides of the left and right side cover panels are respectively positioned adjacent to and opposed from the respective finished sides of the left and right side container body panels.

34 Claims, 26 Drawing Sheets

(56) References Cited

U.S. PATENT DOCUMENTS

| | | | | |
|---|---|---|---|---|
| 5,505,368 | A | 4/1996 | Kanter et al. | |
| 5,507,430 | A | 4/1996 | Imhoff | |
| 5,690,213 | A * | 11/1997 | Matsumura | 206/45.21 |
| 5,762,203 | A | 6/1998 | Klawiter et al. | |
| 5,779,129 | A | 7/1998 | Herbst et al. | |
| 5,950,914 | A * | 9/1999 | Dunton et al. | 229/122 |
| 6,345,758 | B2 * | 2/2002 | Jaggi | 229/123 |
| 6,386,369 | B2 * | 5/2002 | Yuhas et al. | 206/746 |
| 6,729,475 | B2 * | 5/2004 | Yuhas et al. | 206/746 |
| 6,752,262 | B1 | 6/2004 | Boriani et al. | |
| 6,755,306 | B2 * | 6/2004 | Maus | 206/774 |
| D503,614 | S | 4/2005 | Sax et al. | |
| 6,874,678 | B2 | 4/2005 | Prokosch et al. | |
| 6,932,265 | B2 * | 8/2005 | Sax et al. | 229/122 |
| 7,284,662 | B2 * | 10/2007 | DeBusk et al. | 206/745 |
| 7,981,017 | B2 | 7/2011 | Little et al. | |
| 8,028,839 | B2 | 10/2011 | Learn | |
| 2002/0000463 | A1 | 1/2002 | Jaggi | |
| 2005/0184139 | A1 * | 8/2005 | Gasior | 229/240 |
| 2006/0060643 | A1 * | 3/2006 | Sheffer | 229/242 |
| 2008/0197182 | A1 | 8/2008 | Jackson | |
| 2009/0134058 | A1 * | 5/2009 | Alexander | 206/774 |
| 2009/0308786 | A1 | 12/2009 | Urban | |
| 2010/0282831 | A1 * | 11/2010 | Fithian et al. | 229/238 |
| 2011/0049142 | A1 | 3/2011 | Tibbels | |
| 2011/0215137 | A1 | 9/2011 | Snyder | |
| 2013/0150224 | A1 * | 6/2013 | DeCello et al. | 493/405 |

FOREIGN PATENT DOCUMENTS

| | | | |
|---|---|---|---|
| DE | 7305162 | | 10/1973 |
| DE | 7328525 | | 4/1974 |
| DE | 7338793 | | 8/1974 |
| EP | 0763473 | A1 | 3/1997 |
| EP | 1524203 | A2 | 4/2005 |
| FR | 2899566 | A1 | 10/2007 |
| GB | 2419345 | A | 4/2006 |
| GB | 2450245 | A | 12/2008 |
| GB | 2456335 | A | 7/2009 |
| GB | 2464159 | A | 4/2010 |
| WO | 2010/080951 | A2 | 7/2010 |

* cited by examiner

RETAIL READY CONTAINER

BACKGROUND OF THE INVENTION

1. Field of the Invention

This invention relates generally to the field of packaging containers, and more specifically to retail ready containers that are suitable for both shipping a product to a retail establishment and displaying the product to consumers at the retail establishment.

2. Description of the Related Technology

A retail ready container is recognized in the packaging and shipping industries as a container that can perform the dual functions of holding products during the supply chain transportation process and displaying the products in a retail environment. Such containers are typically fabricated from corrugated fiberboard, which is a paper-based material that includes a fluted corrugated sheet and two flat linerboards.

Although retail ready containers have been in commercial use for several decades, conventional retail ready container designs tend to have several disadvantages that prevent them from achieving widespread acceptance among retailers. Corrugated containers may be designed to have a finished surface, such as by including an additional layer of paper on one or both sides, in order to enhance the attractiveness of the container in a retail environment. However, the outside surface of a container can become scratched or marred during the transportation process, resulting in an unsightly appearance that a retailer may find objectionable. Special handing or shrouding of the containers during shipping is not commercially feasible in many instances due to the additional expense.

From a manufacturing and assembly standpoint, many retail ready container designs require assembly from multiple container blanks and multiple gluing and/or taping steps during assembly of the container, which tends to make deployment of such containers more expensive then would otherwise be expected. Many such containers cannot be machine-assembled, meaning that the cost of labor can make the container prohibitively expensive. However, suppliers are being pushed by retailers to supply packaging that is dual purpose. Such containers must be converted from a shipping to a display configuration without any knives or tools into a display case that can be easily placed on a shelf.

A need accordingly exists for an improved retail ready container that is relatively simple and inexpensive to manufacture and assemble, and that provides protection during the shipping and manufacturing process against damage to the surfaces that will be visible to consumers in a retail environment.

SUMMARY OF THE INVENTION

Accordingly, it is an object of the invention to provide improved retail ready container that is relatively simple and inexpensive to manufacture and assemble, and that provides protection during the shipping and manufacturing process against damage to the surfaces that will be visible to consumers in a retail environment.

In order to achieve the above and other objects of the invention, a container blank according to a first aspect of the invention includes a container body portion having a front container body panel, a left side container body panel, a right side container body panel, a rear container body panel and at least one bottom container body panel. The container blank also includes a cover portion having a front cover panel, a left side cover panel and a right side cover panel. The left side cover panel is frangibly attached to the left side container body panel and the right side cover panel is frangibly attached to the right side container body panel.

A retail ready container according to a second aspect of the invention includes a container body portion having a front container body panel, a left side container body panel, a right side container body panel, a rear container body panel and at least one bottom container body panel. The container further includes a protective cover portion having a left side cover panel that is frangibly attached to the left side container body panel and is constructed and arranged to protect at least a portion of the left side container body panel and a right side cover panel that is frangibly attached to the right side container body panel and is constructed and arranged to protect at least a portion of the right side container body panel. Moreover, the container includes a front cover panel that is integral with the left and right side cover panels.

A retail ready container according to a third aspect of the invention includes a container body portion and a protective cover portion that are fabricated from a common container blank having a finished side surface and a unfinished side surface. The container body portion has a front container body panel, a left side container body panel, a right side container body panel, a rear container body panel and at least one bottom container body panel. The protective cover portion has a left side cover panel, a right side cover panel and a front cover panel that is integral with the left and right side cover panels. The finished side surfaces of the left and right side cover panels are positioned so as to be substantially adjacent to and opposed from the respective finished side surfaces of the left and right side container body panels when the retail ready container is assembled.

A method of deploying a retail ready container according to a fourth aspect of the invention includes steps of providing a container blank having a front container body panel, a left side container body panel, a right side container body panel, a rear container body panel, at least one bottom container body panel, a left side cover panel, a right side cover panel and a front cover panel; folding over the container blank so that the front cover panel is juxtaposed with the front container body panel, the left side cover panel is juxtaposed with the left side container body panel and the right side cover panel is juxtaposed with the right side container body panel; and assembling the folded container blank into a container assembly having a retail ready container body portion and a protective cover.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
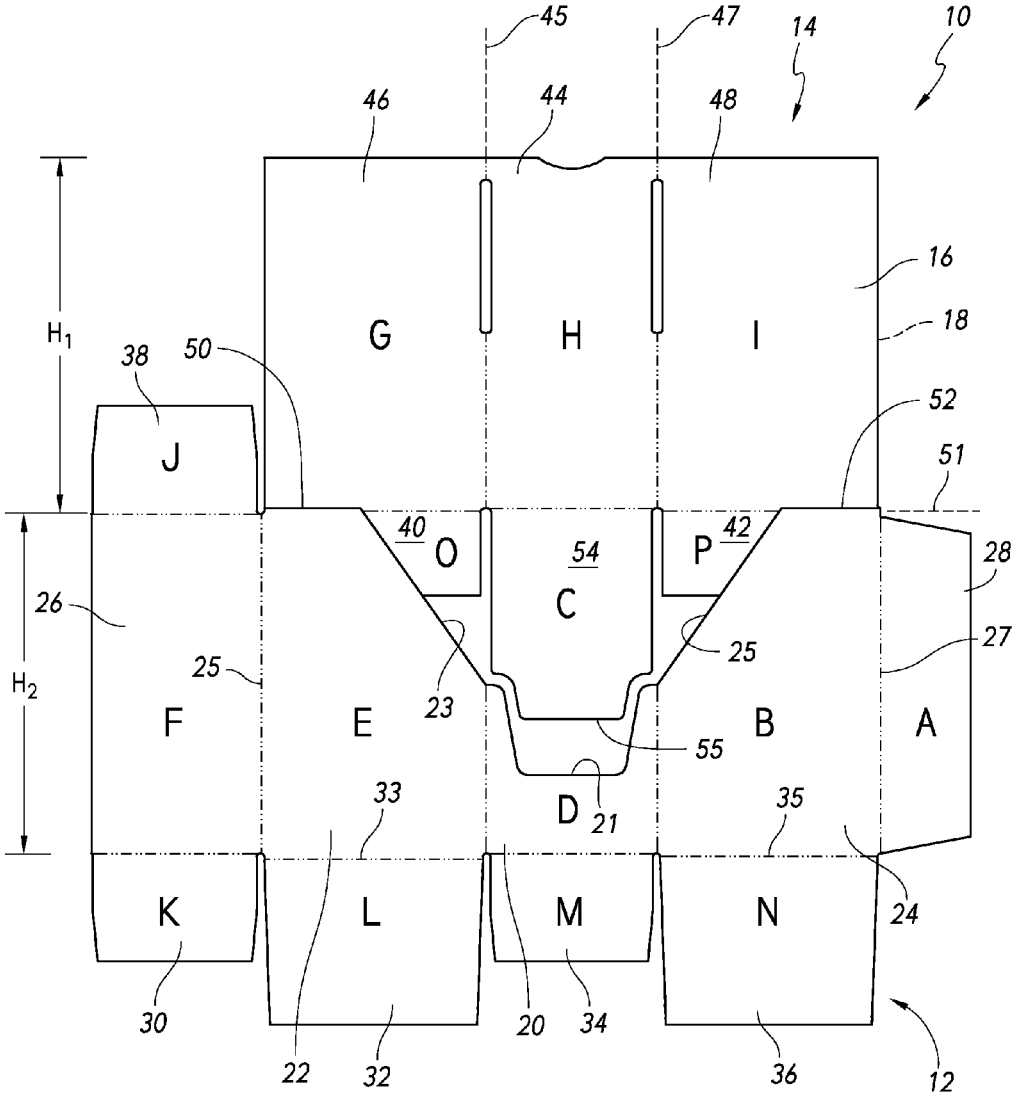
FIG. 1 is a side elevational view of a container blank for a retail ready container that is constructed according to a first embodiment of the invention.

Referring now to the drawings, wherein like reference numerals designate corresponding structure throughout the views, and referring in particular to FIG. 1, a container blank 10 that is constructed according to a preferred embodiment of the invention includes a container body portion 12 and a cover portion 14.

Container blank 10 is constructed and arranged to facilitate assembly of a retail ready container having a one piece design with a built in cover. The top portion of the container blank 10 is designed to fold back onto itself becoming a shipping lid or cover once the carton or container is erected. This secures the product in the tray for shipping and also protects the graphics on the front and side of the container body or tray. The lid or cover is easily removed at retail by tearing the hinged portion that it is originally folded on. The front and sides of the tray remain die cut for a clean appearance on the shelf rather than relying on perforated or tear out features.

Figure 42:
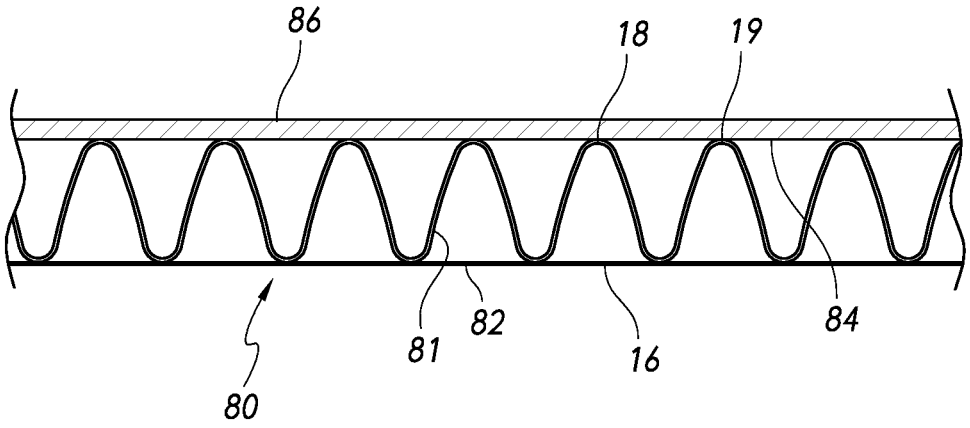
FIG. 42 is a fragmentary cross-sectional view showing a corrugated fiberboard material that is preferably used with all of the above described embodiments.

The container blank 10 is preferably constructed as a single unitary sheet of corrugated fiberboard, sometimes referred to as cardboard. Referring briefly to FIG. 42, it will be seen that the container blank 10 preferably has a first side surface 16 that is unfinished and a second side surface 18 that is finished. Container blank 10 preferably includes a corrugated portion 80 having an inside linerboard 82 and a second outside linerboard 84 between which is defined an internal space having a corrugated medium, which is preferably a fluted corrugated sheet 81.

Alternatively, container blank 10 could have two unfinished surfaces and no finished surface, two finished surfaces or one or more surfaces that has both finished and unfinished portions.

The finished second side surface 18 preferably includes a finishing layer or veneer 86 of paper material that is laminated to the second web 84 in order to provide a more finished, attractive appearance to the second side surface 18. Alternatively, the outside linerboard could itself be a finished material, with no extra laminated layer. The finished material is preferably what is referred to in the industry as a high holdout material, having a clay base to facilitate printing.

Preferably, the corrugated portion 80 has an E-Flute configuration according to the U.S. standard, which provides for 295+/−13 flutes per linear meter and a flute thickness of 1.6 mm. Alternatively, a B-Flute configuration according to the U.S. Standard could be used, which provides for 154+/−10 flutes per linear meter and a flute thickness of 3.2 mm, or any other corrugate material could be used. As a further alternative, any paperboard material could be used.

Referring again FIG. 1, the container body portion 12 preferably includes a front panel 20 that has a profiled upper surface 21 defining a recess that facilitates removal of products by a consumer in a retail setting. The container body portion 12 functions as a display tray in the retail setting. Container body portion 12 further preferably has a right container body panel 22 that is integral with the front container body panel 20 and joined thereto along a vertically oriented fold line 45. Container body portion 12 also includes a left container body panel 24 that is also integral with the front container by the panel 20 and joined thereto along a vertically oriented fold line 47.

Container body portion 12 also includes a rear container body panel 26 that is integral with the right container body panel 22 and joined thereto along a vertically oriented fold line. In addition, a rear container body flap 28 is preferably joined to the left container body panel 24 by a vertically oriented fold line 27.

A rear bottom container body flap 30 and a rear top container body flap 38 are respectively joined to the rear container body panel 26 by horizontally oriented fold lines. A left container body bottom flap 32 is joined to a lower end of the right container body panel 22 by a horizontal fold line 33, and a right container body bottom flap 36 is joined to a lower end of the left container body panel 24 by another horizontal fold line 35 that is preferably substantially aligned with the fold line 33 when the container blank 10 is in the flat configuration shown in FIG. 1.

In the embodiment of the invention that is shown in FIG. 1, the container blank 10 further includes flaps 40, 42 that are respectively joined to lower ends of a right cover panel 46 and a left cover panel 48 along a horizontally oriented fold line 51.

The cover portion 14 includes the right cover panel 46, the left cover panel 48 and a front cover panel 44 as well as the flaps 40, 42. The right cover panel 46 is preferably integral with and joined to the front cover panel 44 along a vertically oriented fold line 45 that is preferably substantially aligned with the fold line that is defined between the front container body panel 20 and right container body panel 22. Similarly, the left cover panel 46 is preferably integral with and joined to an opposite side of the front cover panel 44 along a vertically oriented fold line 47 that is preferably substantially aligned with the fold line that is defined between the front container body panel 20 and the left container body panel 24. The phrase substantially aligned in this context should be interpreted as having sufficient breadth to include the preferred embodiment wherein the width defined between the fold lines 45, 47 in the cover portion 14 is slightly larger than in the container body, so that the cover can fold about the container body in the assembled container 70.

The cover top flap 54 is joined to a lower end of the cover front panel 44 along the fold line 51. Cover top flap 54 preferably has a profiled lower edge 55 that is substantially complementary in shape to the profiled upper surface 21 of the container body front panel 21.

Accordingly, the frangible attachment between the left side cover panel 48 and the left side container body panel 24 and a frangible attachment between the right side cover panel 46 and the right side container body panel 22 are along a common fold line 51. Moreover, the connection between the cover front panel 44 and the cover top flap 54 is along the common fold line 51.

The right side cover panel 46, the cover front panel 44 and the cover left side panel 48 all preferably have a common first height $H_1$, as is shown in FIG. 1. In the preferred embodiment, the right container body panel 22, the left container body panel 24 and the rear container body panel 26 have a common second height $H_2$ that preferably is substantially the same as the first height $H_1$.

As FIG. 1 also shows, the right side container body panel 22 has an upper edge having a first portion 50 that is frangibly joined along the common fold line 51 to the cover right side panel 46 and a second portion 23 that is angled with respect to the first portion 50. Similarly, the left container body panel 24 has an upper edge having a first portion 52 that is frangibly joined to the cover left side panel 48 along the common fold line 51 and a second portion 25 that is angled with respect to the first portion 52.

The second portion 25 of the upper edge of the left side container body panel 24 is preferably substantially symmetrical with respect to the second portion 23 of the upper edge of the right side container body panel 22 along a vertical axis. Moreover, the right side container body panel 22 has a shape that is substantially symmetrical with respect to the left side container body panel 24 along the same vertical axis.

As will be described in greater detail below, the cover portion 14 is constructed and arranged to protect during the shipping and transportation process the surfaces of the retail ready container 10 that are most likely to be within view of consumers in a retail setting, i.e. the finished surfaces of the right side container body panel 22, the left side container body panel 24 and the front container body panel 20.

Figure 2:
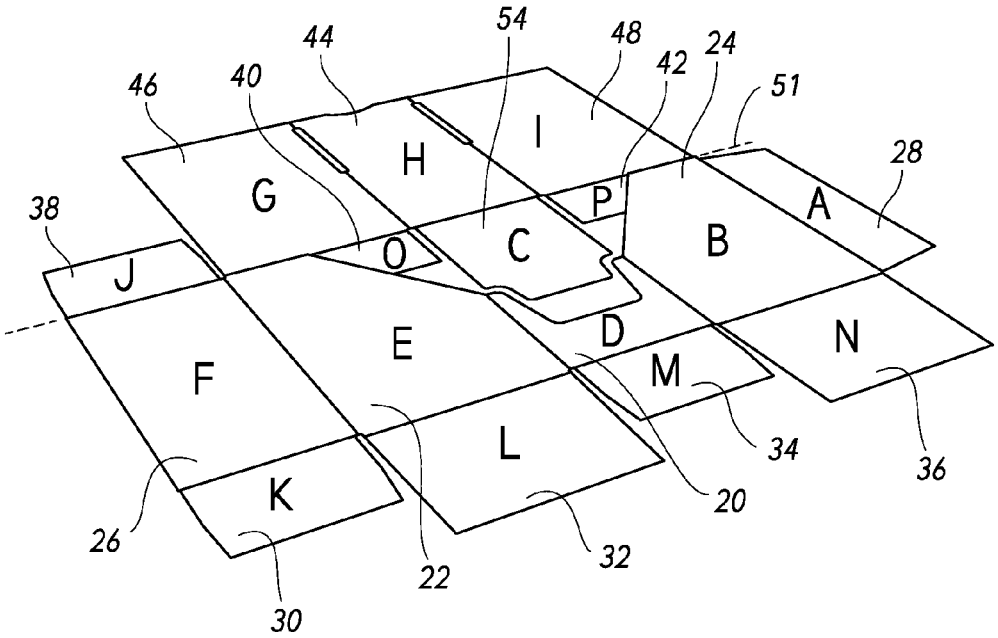
FIG. 2 is a perspective view of the container blank shown in FIG. 1, shown in a first operative position.
Figure 3:
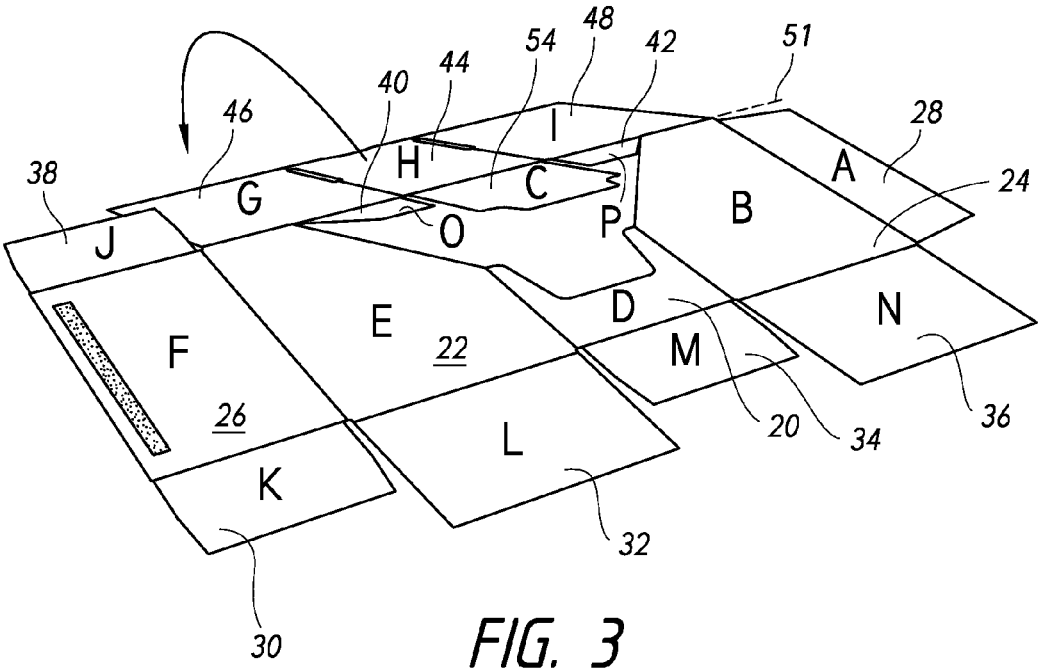
FIG. 3 is a perspective view of the container blank shown in FIG. 1, shown in a second operative position.

Referring now to FIGS. 2 and 3, the preferred method for assembling a retail ready container from the container blank 10 includes a first step of folding the cover portion 14 backwardly along the common fold line 51 until the finished surfaces of the cover front panel 44, the cover right side panel 46 and a cover left side panel 48, which are on the second side 18 of the container blank 10, are opposed to and substantially in contact with the finished surfaces, respectively, of the container body front panel 21, the container body right panel 22 and the container body left panel 24.

Figure 4:
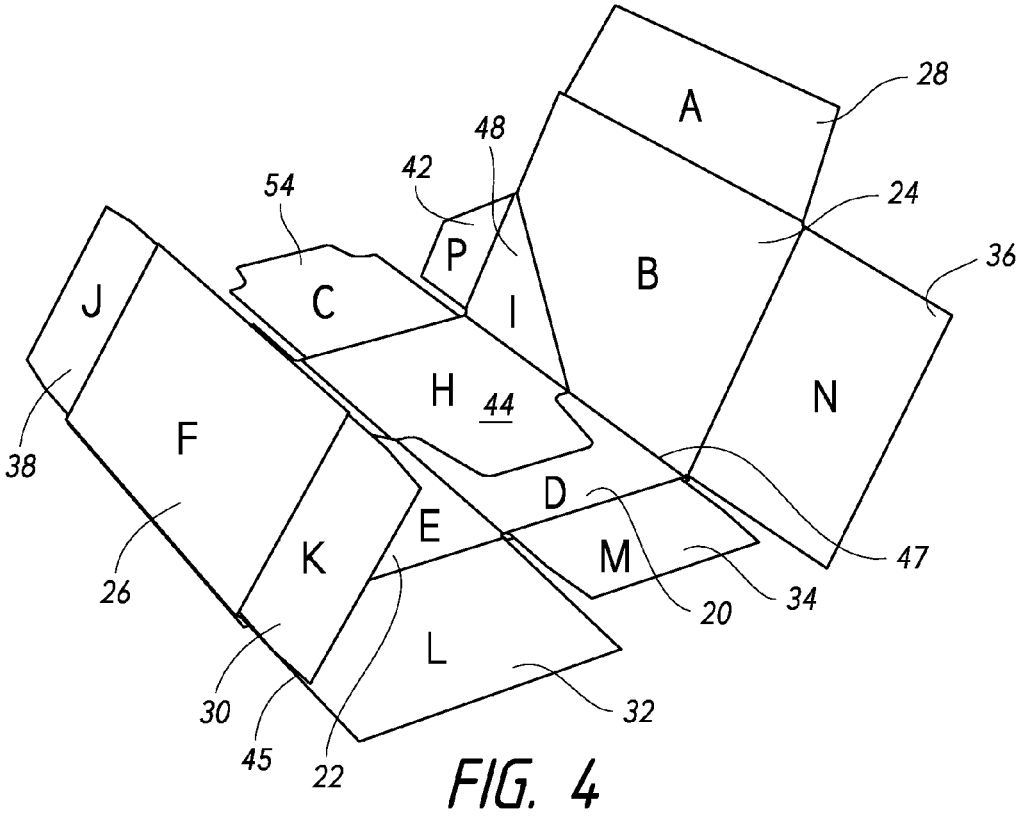
FIG. 4 is a perspective view of the container blank shown in FIG. 1, shown in a third operative position.
Figure 5:
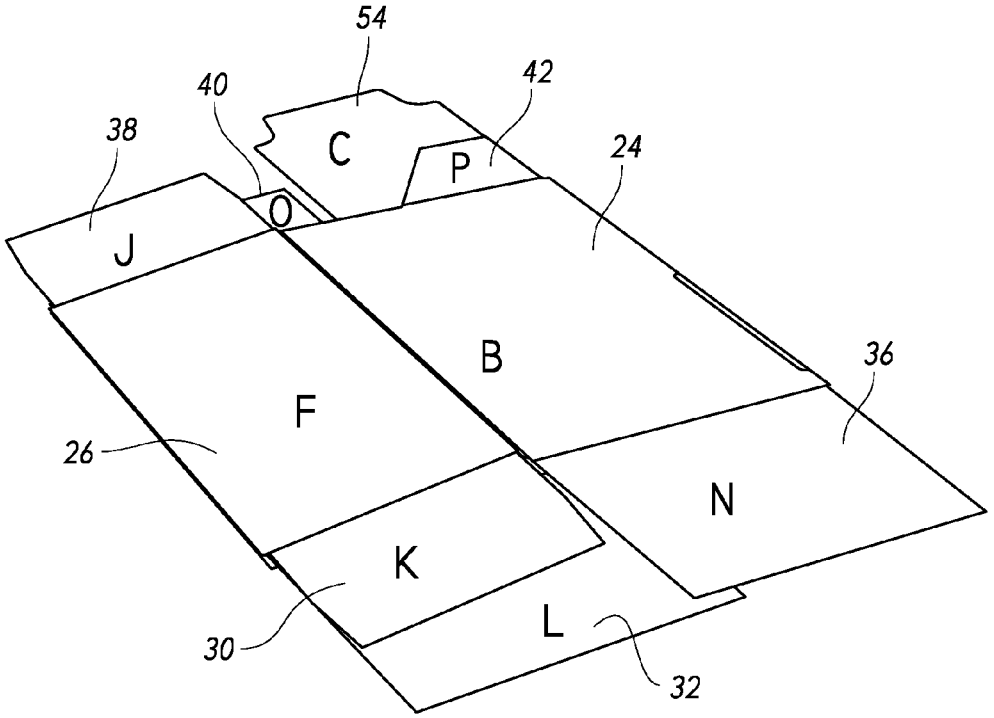
FIG. 5 is a perspective view of the container blank shown FIG. 1, shown in a fourth operative position.
Figure 6:
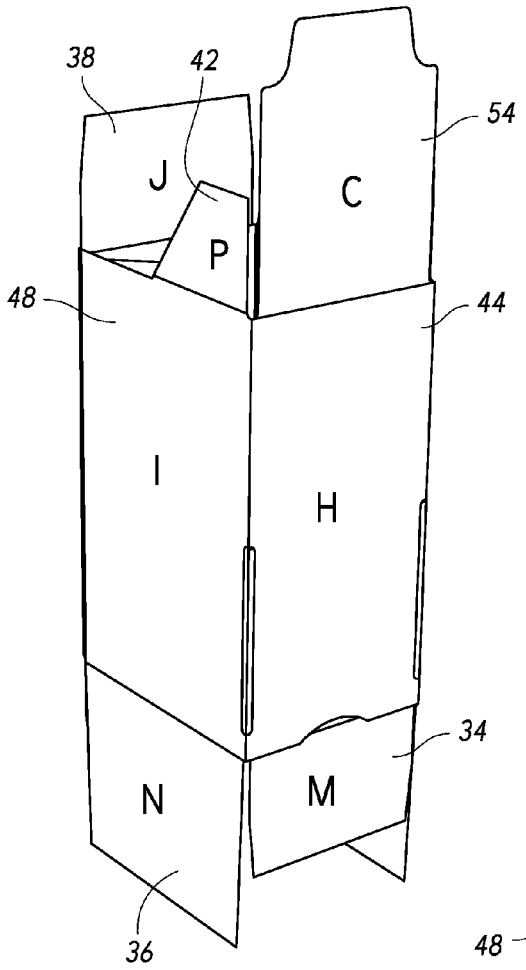
FIG. 6 is a perspective view of the container blank shown in FIG. 1, shown in a fifth operative position.
Figure 7:
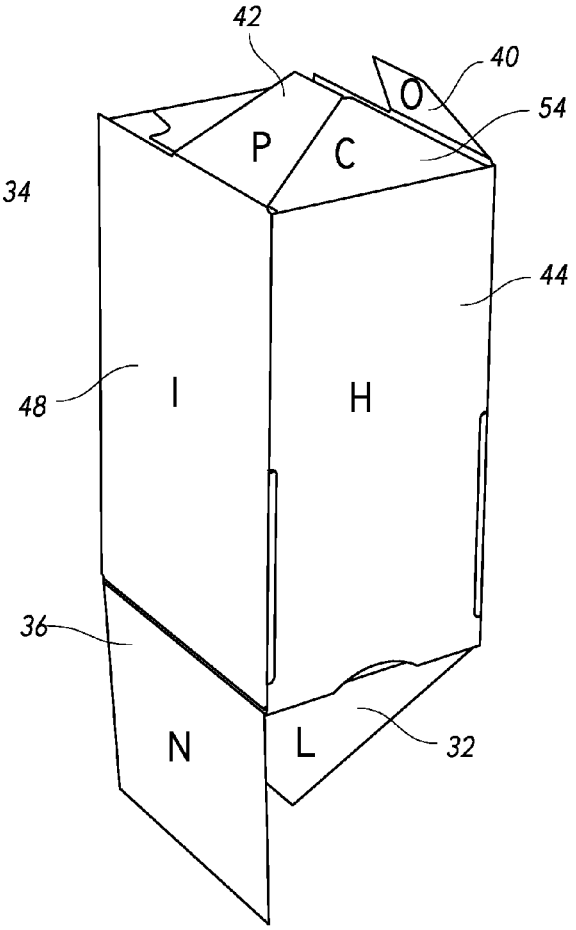
FIG. 7 is a perspective view of the container blank shown in FIG. 1, shown in a sixth operative position.

As FIGS. 4 and 5 show, the container blank 10 is then folded at the fold lines 45, 47, and the rear flap 28 is secured to the rear container body body panel 26 by taping or gluing. The top of the retail ready container is then assembled as shown in FIG. 6 by folding the rear top flap 38 downwardly along the fold line 51, folding the cover top 54 downwardly so as to overlie the rear top flap 38 and then folding the flaps 40, 42 downwardly and securing them to the cover top flap 54 by taping or gluing.

Figure 8:
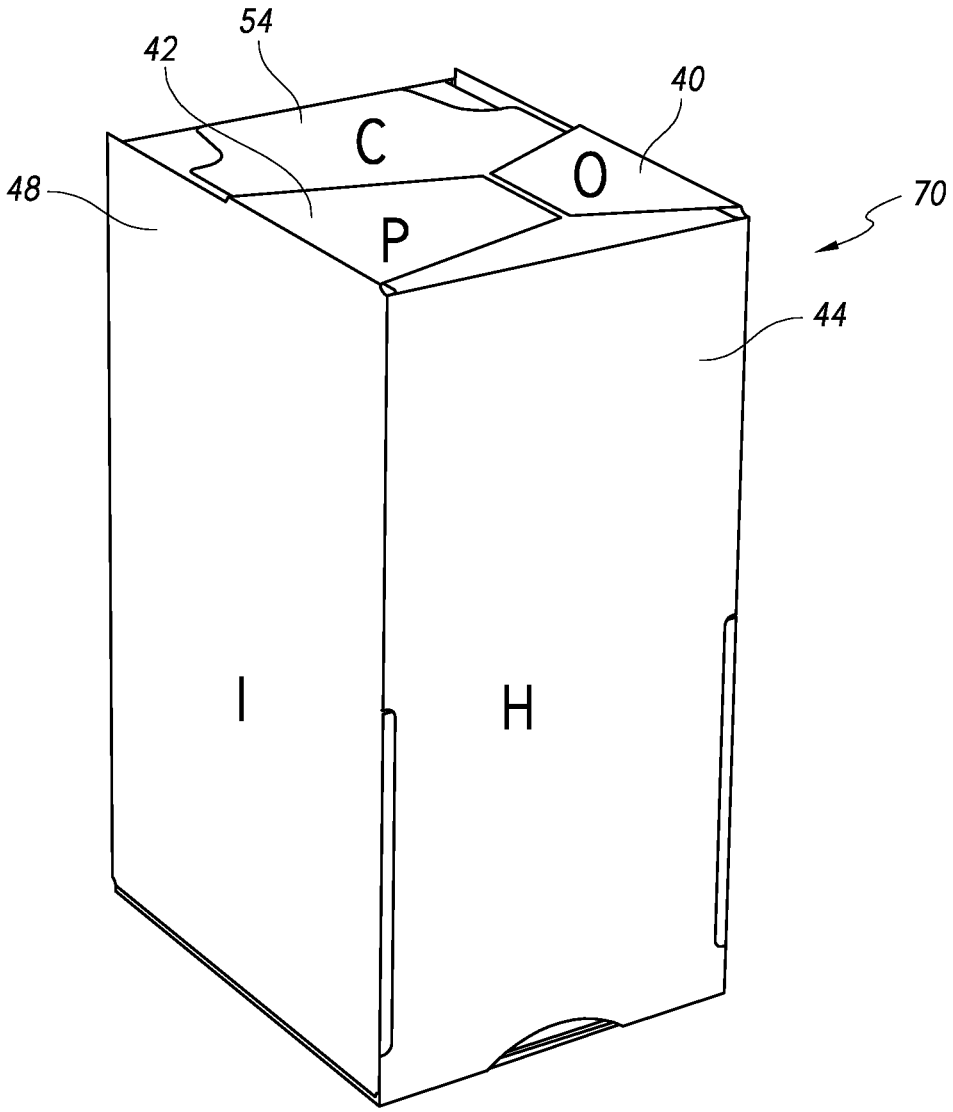
FIG. 8 is a perspective view of the container blank shown in FIG. 1, shown in a seventh operative position.

The bottom of the retail ready container 70 is then assembled by folding the rear and front bottom container flaps 30, 34 inwardly, folding the left bottom container body flap 32 inwardly and then folding the right container body bottom flap 36 inwardly, as is shown in FIG. 8. The flap 36 may be secured to the flap 32 by taping or gluing.

One advantage of the retail ready container 70 is at the foregoing assembly steps may be performed using automated machinery rather than manually, which saves labor costs in comparison to manual assembly.

Figure 9:
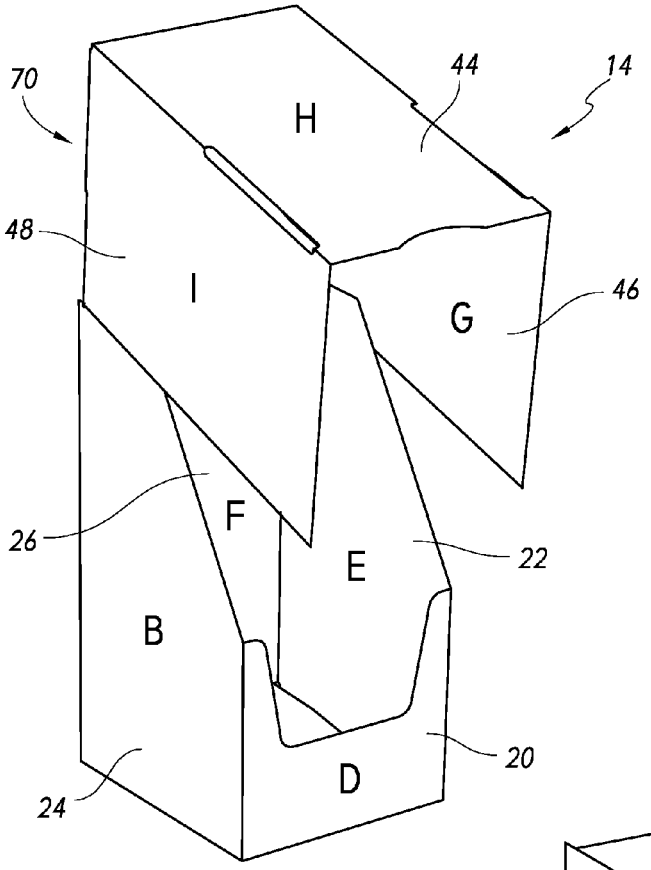
FIG. 9 is a perspective view of the retail ready container assembled from the blank shown in FIG. 1, shown in a first operative position.

As may best be visualized in FIG. 9, the protective cover portion 14 of the retail ready container 70 is configured so that the left side cover panel 48 protects at least a portion of the left side container body panel 24 and so that the right side cover panel 46 protects the right container body panel 22 during shipping and transportation. In the preferred embodiment, the respective cover panels 46, 48 have substantially the same height as the container body panels 22, 24, so substantially the entire container body panel 22, 24 is protected. In addition, the cover front panel 44 preferably overlies and protects substantially the entire front face of the front container body panel 20 during shipping and transportation.

After the retail ready container 70 containing product has been received in a retail establishment, it is prepared for dispensing product by pulling the cover portion 14 upwardly in a pivotal movement, as is best shown in FIG. 9. As this occurs, the frangible attachment between the right side cover panel 46 and the right side container body panel 22 as well as the frangible attachment between the left side cover panel 48 and the left container body panel 24 are at least partially torn. The pivotal movement preferably occurs about an axis that includes pivot points along the common fold line 51 as shown in FIG. 1 along the respective frangible connections 50, 52.

Figure 10:
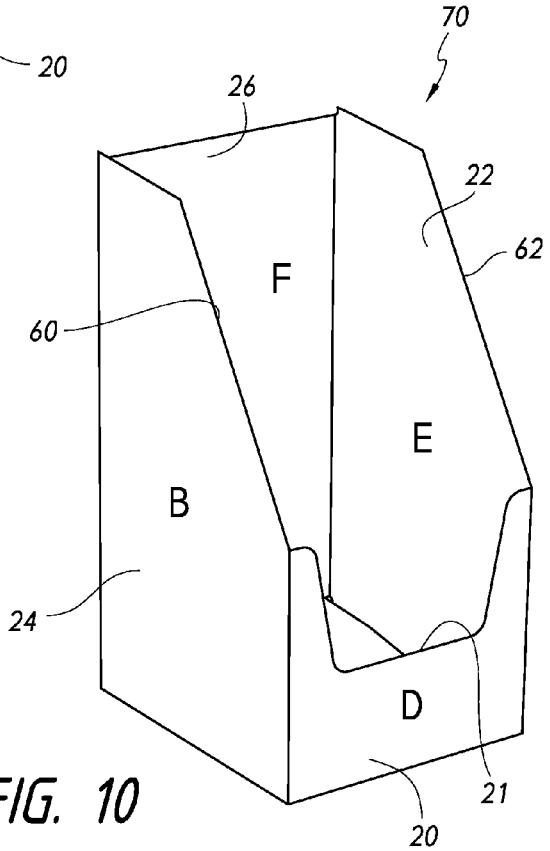
FIG. 10 is a perspective view of the retail ready container shown in FIG. 9, with the cover portion removed.

After the cover portion 14 has been completely removed, the retail ready container 70 will have an exposed access opening defined by the profiled upper edge 21 of the container body front panel 20, as is shown in FIG. 10. This allows consumers to more conveniently view and remove product from the retail ready container 70 as it functions as a display tray.

Referring now to the FIGS. 11-20, a container blank 110 that is constructed according to a second embodiment of the invention includes a container body portion 112 and a cover portion 114.

Container blank 110 is preferably constructed as a single unitary sheet of corrugated fiberboard, preferably the same material described previously with respect to the first embodiment.

The container body portion 112 preferably includes a front panel 120 that has a profiled upper surface 121 defining a recess that facilitates removal of products by a consumer in a retail setting. Container body portion 112 further preferably has a right container body panel 122 that is integral with the front container body panel 120 and joined thereto along a vertically oriented fold line 145. Container body portion 112 also includes a left container body panel 124 that is also integral with the front container body panel 120 and joined thereto along a vertically oriented fold line 147.

Container body portion 112 also includes a rear container body panel 126 that is integral with the right container body panel 122 and joined thereto along a vertically oriented fold line. In addition, a rear container body flap 128 is preferably joined to the left container body panel 124 by a vertically oriented fold line 127.

A rear bottom container body flap 130 and a rear top container body flap 138 are respectively joined to the rear container body panel 126 by horizontally oriented fold lines. A left container body bottom flap 132 is joined to a lower end of the right container body panel 122 by a horizontal fold line 133, and a right container body bottom flap 136 is joined to a lower end of the left container body panel 124 by another horizontal fold line 135 that is preferably substantially aligned with the fold line 133 when the container blank 110 is in the flat configuration shown in FIG. 11.

Figure 11:
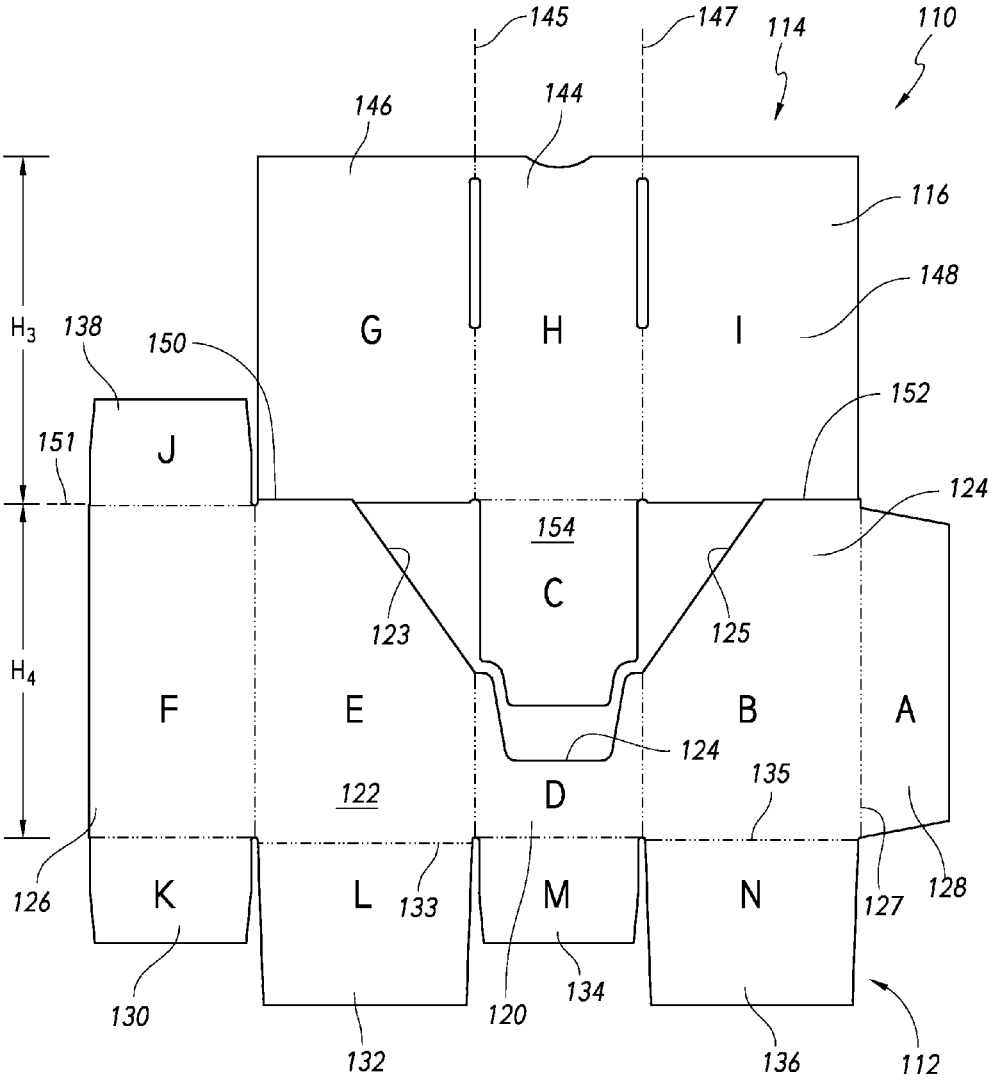
FIG. 11 is a side elevational view of a container blank for a retail ready container that is constructed according to a second embodiment of the invention.

The embodiment of the invention that is shown in FIG. 11 lacks the flaps 40, 42 that were present in the first embodiment.

The cover portion 114 includes the right cover panel 146, the left cover panel 148 and a front cover panel 144. The right cover panel 146 is preferably integral with and joined to the front cover panel 144 along a vertically oriented fold line 145 that is preferably substantially aligned with the fold line that is defined between the front container body panel 120 and right container body panel 122. Similarly, the left cover panel 146 is preferably integral with and joined to an opposite side of the front cover panel 144 along a vertically oriented fold line 147 that is preferably substantially aligned with the fold line that is defined between the front container body panel 120 and the left container body panel 124.

The cover top flap 154 is joined to a lower end of the cover front panel 144 along a common fold line 151. Cover top flap 154 preferably has a profiled lower edge 155 that is substantially complementary in shape to the profiled upper surface 121 of the container body front panel 120.

Accordingly, the frangible attachment between the left side cover panel 148 and the left side container body panel 124 and the frangible attachment between the right side cover panel 146 and the right side container body panel 122 are along the common fold line 151. Moreover, the connection between the cover front panel 144 and the cover top flap 154 is along the common fold line 151.

The right side cover panel 146, the cover front panel 144 and the cover left side panel 148 all preferably have a common first height $H_3$, as is shown in FIG. 11. In the preferred embodiment, the right container body panel 122, the left container body panel 124 and the rear container body panel 126 have a common second height $H_4$ that preferably is substantially the same as the first height $H_3$.

As FIG. 11 also shows, the right side container body panel 122 has an upper edge having a first portion 150 that is frangibly joined along the common fold line 151 to the cover right side panel 146 and a second portion 123 that is angled with respect to the first portion 150. Similarly, the left container body panel 124 has an upper edge having a first portion 152 that is frangibly joined to the cover left side panel 148 along the common fold line 151 and a second portion 125 that is angled with respect to the first portion 152.

The second portion 125 of the upper edge of the left side container body panel 124 is preferably substantially symmetrical with respect to the second portion 123 of the upper edge of the right side container body panel 122 along a vertical axis. Moreover, the right side container body panel 122 has a shape that is substantially symmetrical with respect to the left side container body panel 124 along the same vertical axis.

As will be described in greater detail below, the cover portion 114 is constructed and arranged to protect during the shipping and transportation process the surfaces of the retail ready container 110 that are most likely to be within view of consumers in a retail setting, i.e. the finished surfaces of the right side container body panel 122, the left side container body panel 124 and the front container body panel 120.

Figure 12:
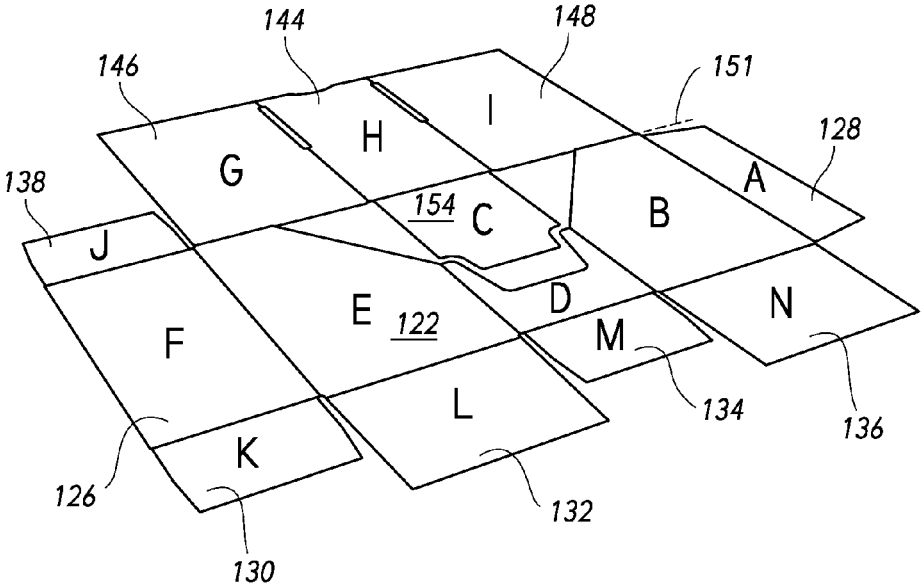
FIG. 12 is a perspective view of the container blank shown in FIG. 11, shown in a first operative position.
Figure 13:
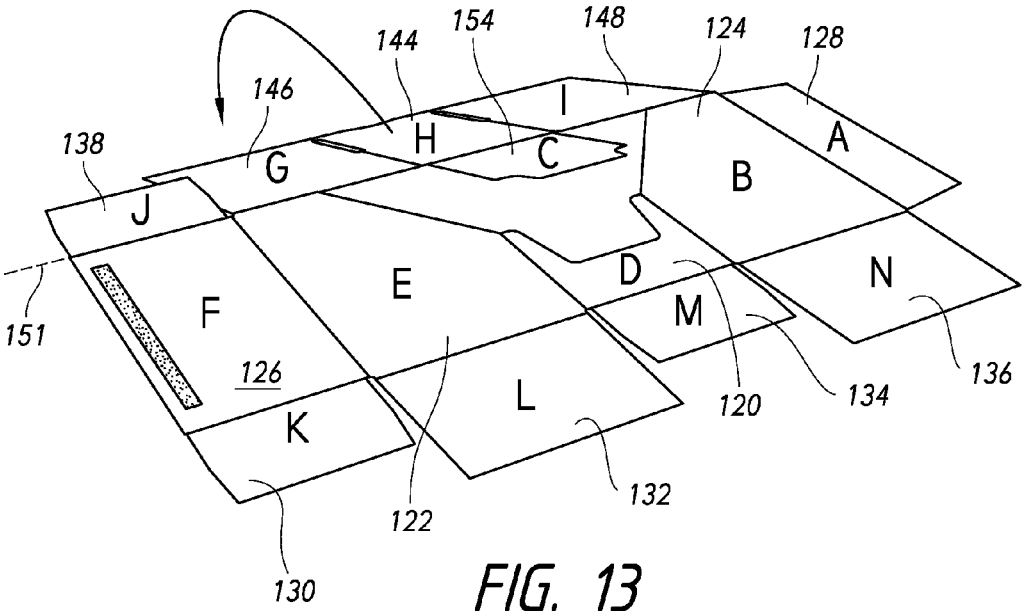
FIG. 13 is a perspective view of the container blank shown in FIG. 11, shown in a second operative position.

Referring now to FIGS. 12 and 13, the preferred method for assembling a retail ready container 170 from the container blank 110 includes a first step of folding the cover portion 114 backwardly along the common fold line 151 until the finished surfaces of the cover front panel 144, the cover right side panel 146 and a cover left side panel 148, which are on the second side 118 of the container blank 10, are opposed to and substantially in contact with the finished surfaces, respectively, of the container body front panel 121, the container body right panel 122 and the container body left panel 124.

Figure 14:
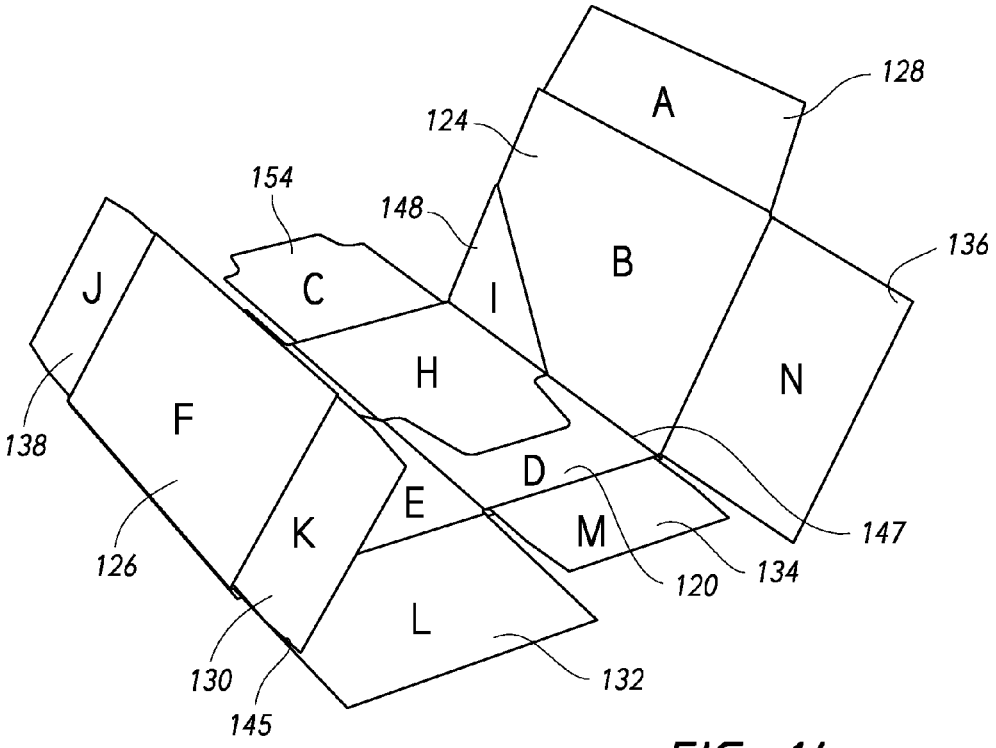
FIG. 14 is a perspective view of the container blank shown in FIG. 11, shown in a third operative position.
Figure 15:
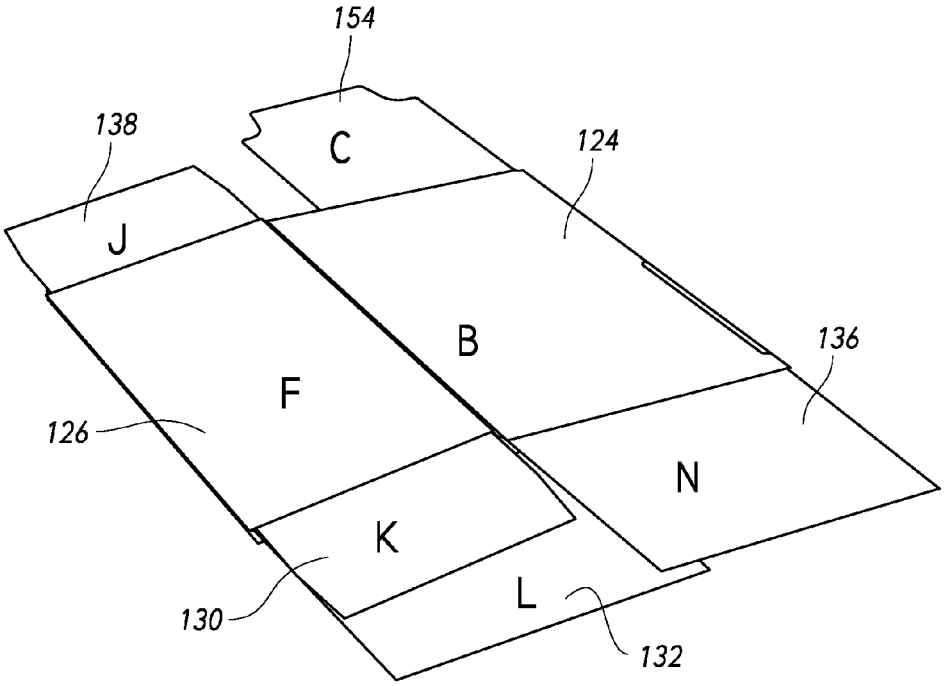
FIG. 15 is a perspective view of the container blank shown in FIG. 11, shown in a fourth operative position.
Figure 16:
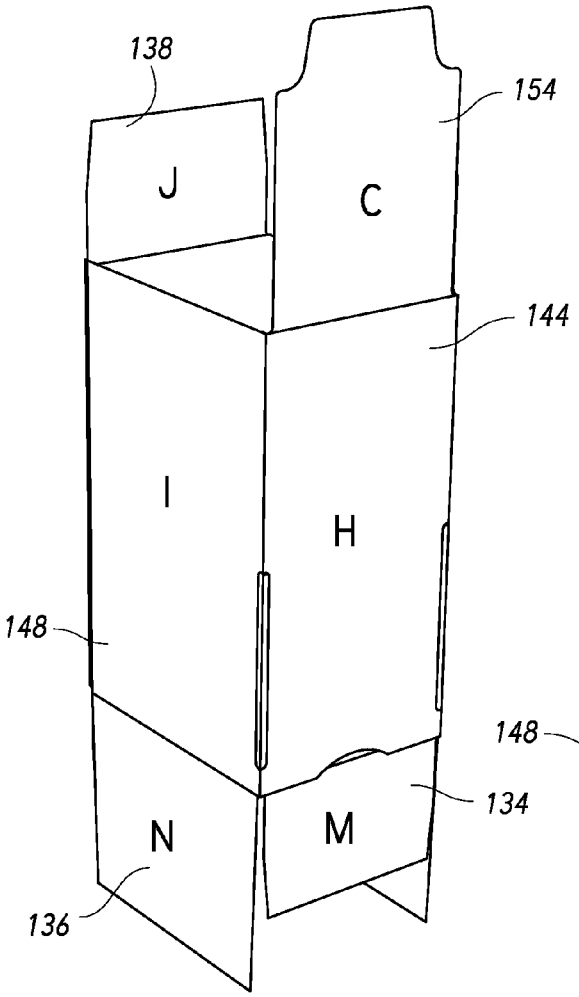
FIG. 16 is a perspective view of the container blank shown in FIG. 11, shown in a fifth operative position.
Figure 17:
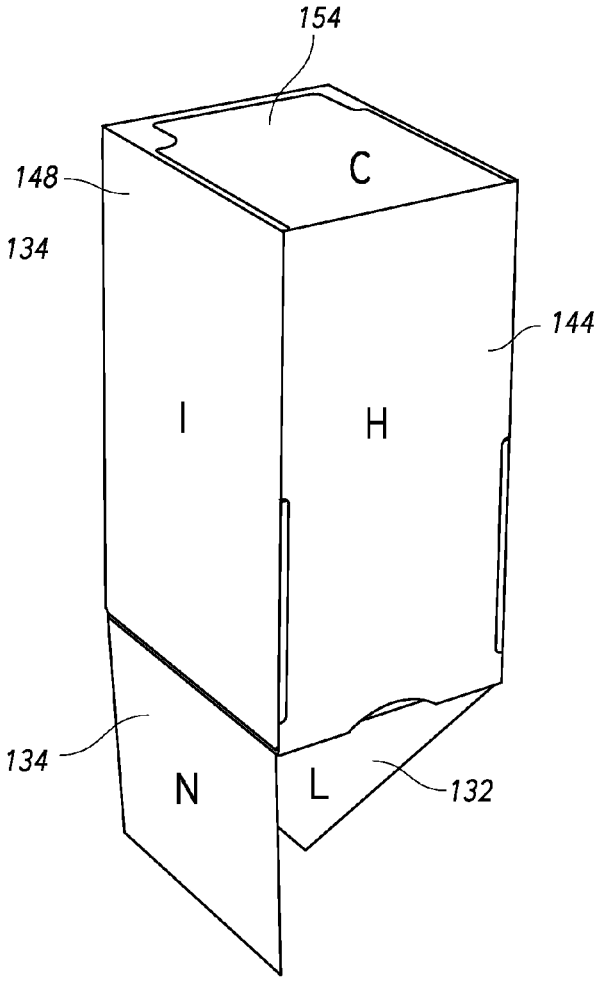
FIG. 17 is a perspective view of the container blank shown in FIG. 11, shown in the sixth operative position.

As FIGS. 14 and 15 show, the container blank 110 is then folded at the fold lines 145, 147, and the rear flap 128 is secured to the rear container body body panel 126 by taping or gluing. The top of the retail ready container is then assembled as shown in FIG. 16 by folding the rear top flap 138 downwardly along the fold line 151 and folding the cover top 154 downwardly so as to overlie the rear top flap 138 and then securing the flaps 138, 154 by taping or gluing.

Figure 18:
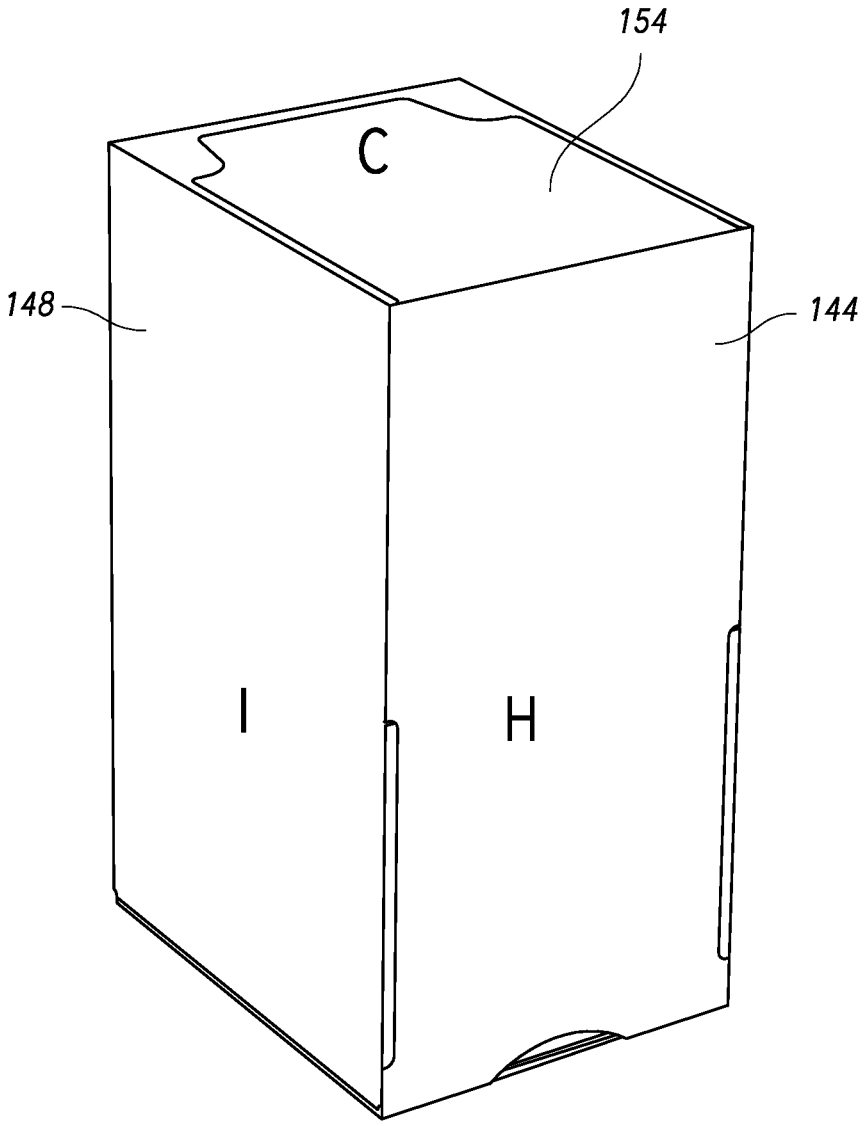
FIG. 18 is a perspective view of the container blank shown in FIG. 11, shown in a seventh operative position.

The bottom of the retail ready container 170 is then assembled by folding the rear and front bottom container flaps 130, 134 inwardly, folding the left bottom container body flap 132 inwardly and then folding the right container body bottom flap 136 inwardly, as is shown in FIG. 18. The flap 136 may be secured to the flap 132 by taping or gluing.

One advantage of the retail ready container 170 is at the foregoing assembly steps may be performed using automated machinery rather than manually, which saves labor costs in comparison to manual assembly.

Figure 19:
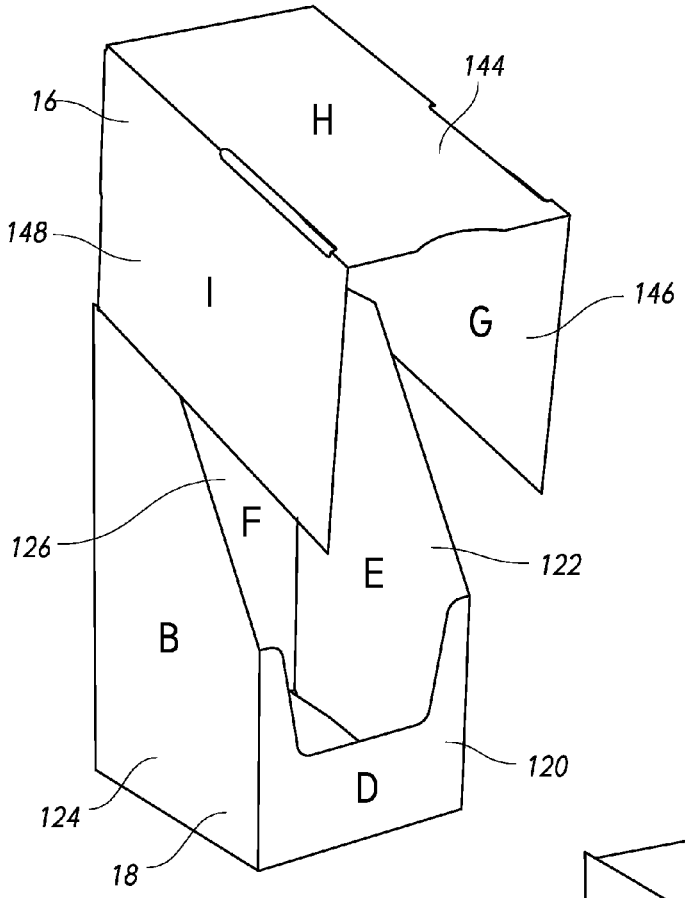
FIG. 19 is a perspective view of a container constructed from the container blank shown in FIG. 11, shown in a first operative position.

As may best be visualized in FIG. 19, the protective cover portion 114 of the retail ready container 170 is configured so that the left side cover panel 148 protects at least a portion of the left side container body panel 124 and so that the right side cover panel 146 protects the right container body panel 122 during shipping and transportation. In the preferred embodiment, the respective cover panels 146, 148 have substantially the same height as the container body panels 122, 124, so substantially the entire container body panel 122, 124 is protected. In addition, the cover front panel 144 preferably overlies and protects substantially the entire front face of the front container body panel 120 during shipping and transportation.

After the retail ready container 170 containing product has been received in a retail establishment, it is prepared for dispensing product by pulling the cover portion 114 upwardly in a pivotal movement, as is best shown in FIG. 19. as this occurs, the frangible attachment between the right side cover panel 146 and the right side container body panel 122 as well as the frangible attachment between the left side cover panel 148 and the left container body panel 124 are at least partially torn. The pivotal movement preferably occurs about an axis that includes pivot points along the common fold line 151 as shown in FIG. 1 along the respective frangible connections 150, 152.

Figure 20:
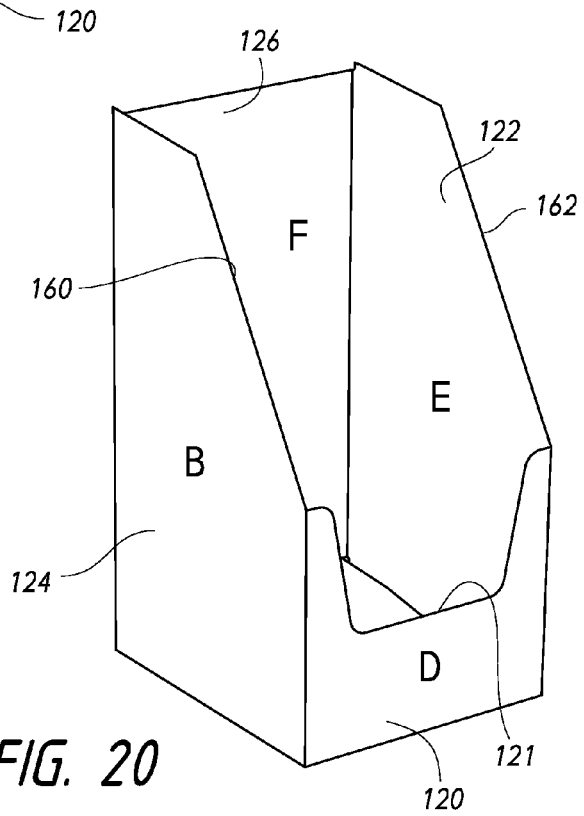
FIG. 20 is a perspective view of the container shown in FIG. 19, with the cover portion removed.

After the cover portion 114 has been completely removed, the retail ready container 170 will have an exposed access opening defined by the profiled upper edge 121 of the container body front panel 20, as is shown in FIG. 20. This allows consumers to more conveniently view and remove product from the retail ready container 70.

Referring now to the FIGS. 21-30, a container blank 210 that is constructed according to a third embodiment of the invention includes a container body portion 212 and a cover portion 214. This option has the addition of tabs 258, 260, 264, 268. This allows the side flaps to be glued in place for added protection. They would be pulled outward to release the carton sides. The cover 214 then would be removed in the same manner as described above with reference to the first two embodiments.

Container blank 210 is preferably constructed as a single unitary sheet of corrugated fiberboard, preferably the same material described previously with respect to the first embodiment.

The container body portion 212 preferably includes a front panel 220 that has a profiled upper surface 221 defining a recess that facilitates removal of products by a consumer in a retail setting. Container body portion 212 further preferably has a right container body panel 222 that is integral with the front container body panel 220 and joined thereto along a vertically oriented fold line 245. Container body portion 212 also includes a left container body panel 224 that is also integral with the front container body panel 220 and joined thereto along a vertically oriented fold line 247.

Container body portion 212 also includes a rear container body panel 226 that is integral with the right container body panel 222 and joined thereto along a vertically oriented fold line. In addition, a rear container body flap 228 is preferably joined to the left container body panel 224 by a vertically oriented fold line 227.

A rear bottom container body flap 230 and a rear top container body flap 238 are respectively joined to the rear container body panel 126 by horizontally oriented fold lines. A left container body bottom flap 232 is joined to a lower end of the right container body panel 222 by a horizontal fold line 233, and a right container body bottom flap 236 is joined to a lower end of the left container body panel 224 by another horizontal fold line 235 that is preferably substantially aligned with the fold line 233 when the container blank 210 is in the flat configuration shown in FIG. 21.

Figure 21:
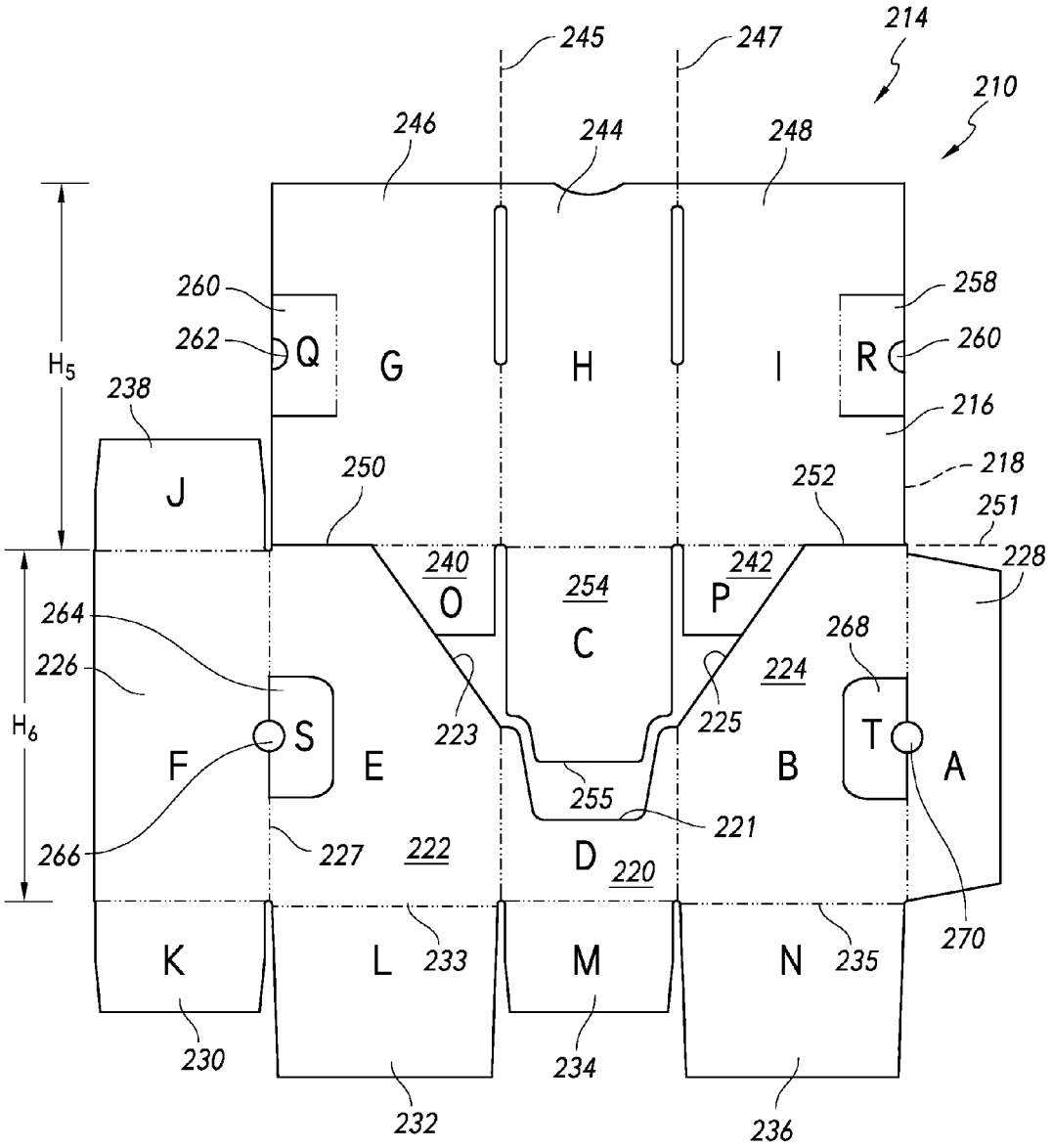
FIG. 21 is a side elevational view of a container blank that is constructed according to a third embodiment of the invention.

The embodiment of the invention that is shown in FIG. 21 further includes flaps 240, 242 that are similar to the flaps 40, 42 described with respect to the first embodiment.

The cover portion 214 includes the right cover panel 246, the left cover panel 248 and a front cover panel 244. The right cover panel 246 is preferably integral with and joined to the front cover panel 244 along a vertically oriented fold line 245 that is preferably substantially aligned with the fold line that is defined between the front container body panel 220 and right container body panel 222. Similarly, the left cover panel 246 is preferably integral with and joined to an opposite side of the front cover panel 244 along a vertically oriented fold line 247 that is preferably substantially aligned with the fold line that is defined between the front container body panel 220 and the left container body panel 224.

The cover portion 214 further preferably includes a tab 258 having a hole 260 defined therein that is attached to the left cover panel 248 by a vertical fold line, and another tab 260 having a hole 262 defined therein that is attached to the right cover panel 246 by a vertical fold line.

The cover top flap 254 is joined to a lower end of the cover front panel 244 along a common fold line 151. Cover top flap 254 preferably has a profiled lower edge 255 that is substantially complementary in shape to the profiled upper surface 221 of the container body front panel 220.

Accordingly, the frangible attachment between the left side cover panel 248 and the left side container body panel 224 and the frangible attachment between the right side cover panel 246 and the right side container body panel 222 are along the common fold line 251. Moreover, the connection between the cover front panel 244 and the cover top flap 254 is along the common fold line 251.

The right side cover panel 246, the cover front panel 244 and the cover left side panel 248 all preferably have a common first height $H_5$, as is shown in FIG. 21. In the preferred embodiment, the right container body panel 222, the left container body panel 224 and the rear container body panel 226 have a common second height $H_6$ that preferably is substantially the same as the first height $H_5$.

As FIG. 21 also shows, the right side container body panel 222 has an upper edge having a first portion 250 that is frangibly joined along the common fold line 251 to the cover right side panel 246 and a second portion 223 that is angled with respect to the first portion 250. Similarly, the left container body panel 224 has an upper edge having a first portion 252 that is frangibly joined to the cover left side panel 248 along the common fold line 251 and a second portion 225 that is angled with respect to the first portion 252.

The second portion 225 of the upper edge of the left side container body panel 224 is preferably substantially symmetrical with respect to the second portion 223 of the upper edge of the right side container body panel 222 along a vertical axis. Moreover, the right side container body panel 222 has a shape that is substantially symmetrical with respect to the left side container body panel 224 along the same vertical axis.

The left side container body panel 224 preferably includes a tab 268 having a hole 270 and the right side container body panel 222 has a tab 268 having a hole 270. The periphery of the tabs 264, 268 are preferably perforated so that they may be torn out by grasping and pulling using the respective hole 266, 270. Tabs 258, 260 are designed to stay attached to the respective panel 248, 246. Tab 268 is preferably glued to the tab 258 during the assembly process, and the tab 264 is glued to the tab 260.

As will be described in greater detail below, the cover portion 214 is constructed and arranged to protect during the shipping and transportation process the surfaces of the retail ready container 210 that are most likely to be within view of consumers in a retail setting, i.e. the finished surfaces of the right side container body panel 222, the left side container body panel 224 and the front container body panel 220.

Figure 22:
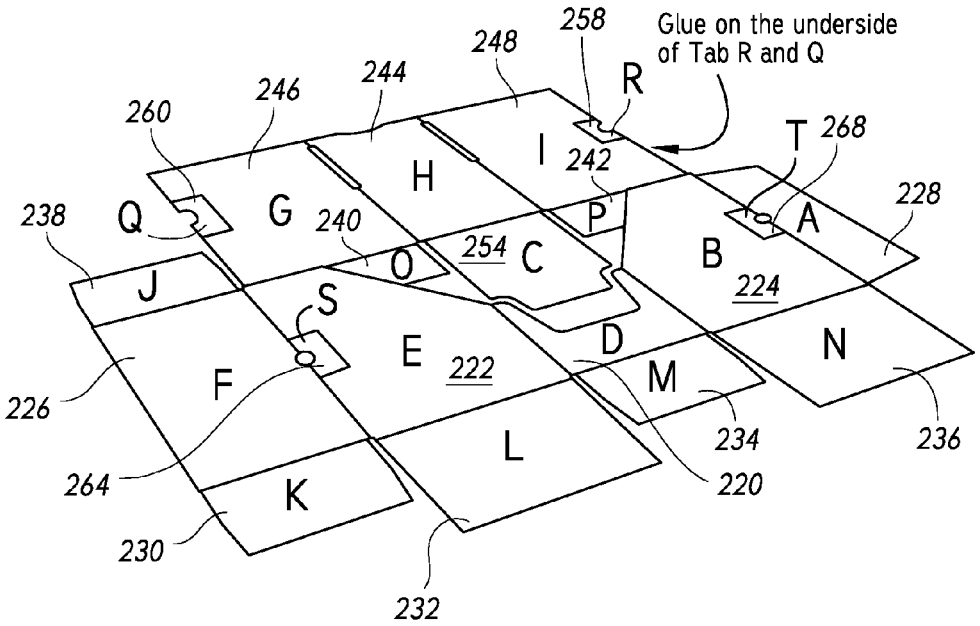
FIG. 22 is a perspective view of the container blank shown in FIG. 21, shown in a first operative position.
Figure 23:
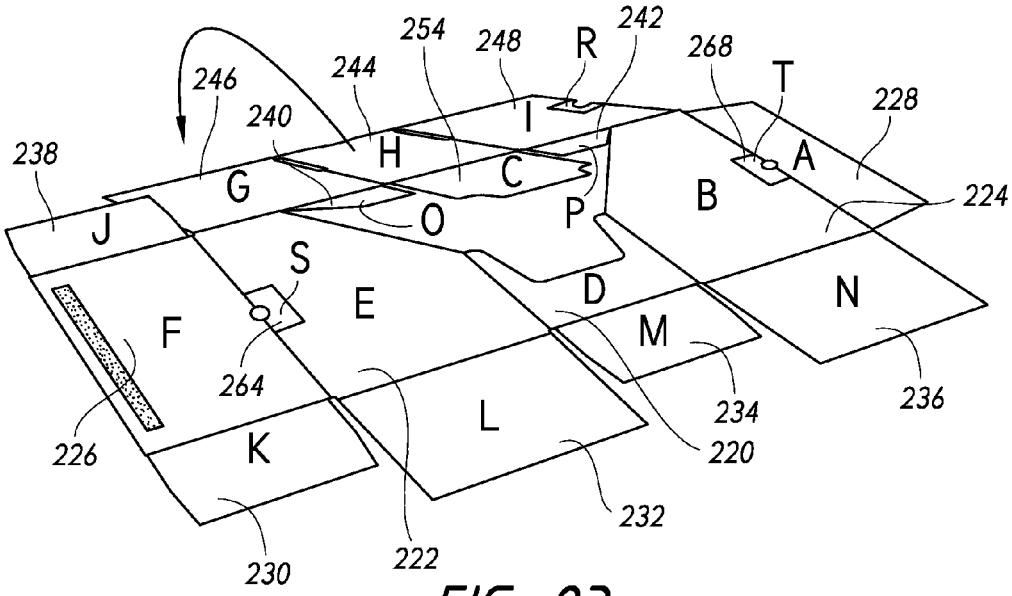
FIG. 23 is a perspective view of the container blank shown in FIG. 21, shown in a second operative position.

Referring now to FIGS. 22 and 23, the preferred method for assembling a retail ready container 270 from the container blank 210 includes a first step of folding the cover portion 214 backwardly along the common fold line 251 until the finished surfaces of the cover front panel 244, the cover right side panel 246 and a cover left side panel 248, which are on the second side 218 of the container blank 210, are opposed to and substantially in contact with the finished surfaces, respectively, of the container body front panel 221, the container body right panel 222 and the container body left panel 224.

Figure 24:
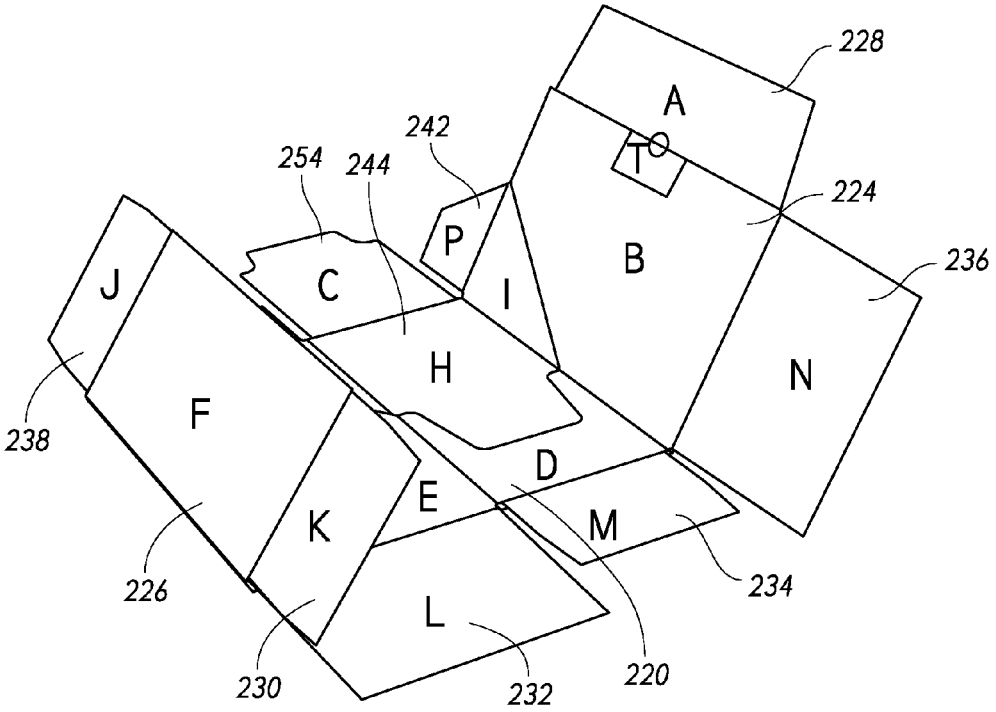
FIG. 24 is a perspective view of the container blank shown in FIG. 21, shown in a third operative position.
Figure 25:
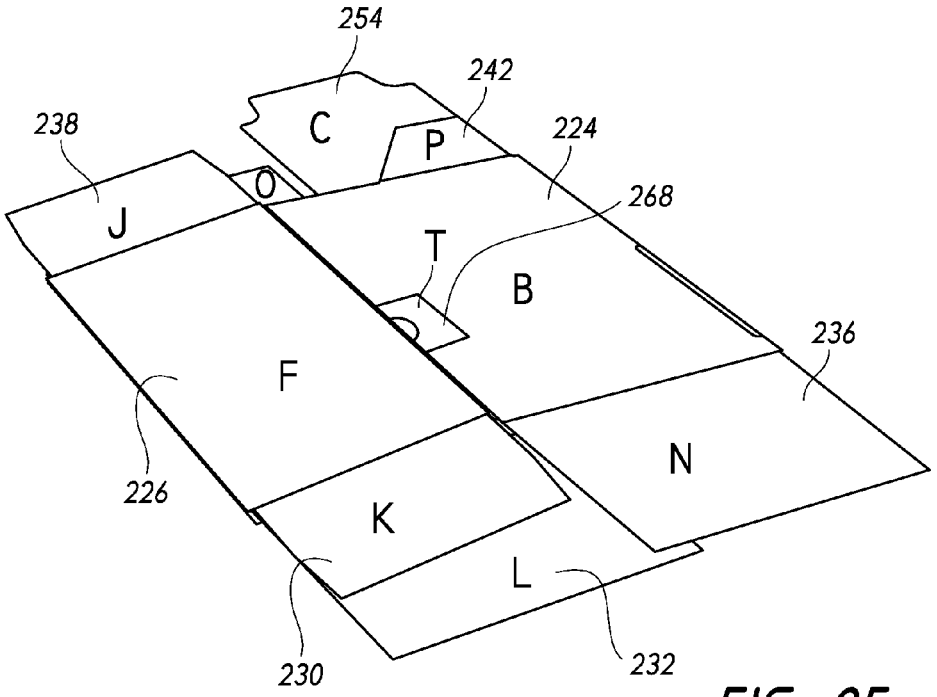
FIG. 25 is a perspective view of the container blank shown in FIG. 21, shown in a fourth operative position.
Figure 26:
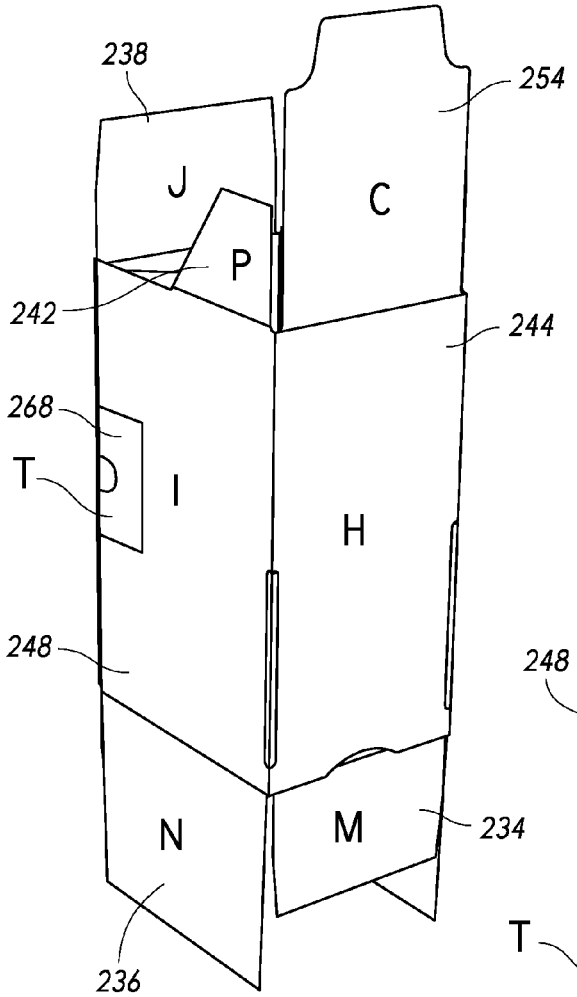
FIG. 26 is a perspective view of the container blank shown in FIG. 21, shown in a fifth operative position.
Figure 27:
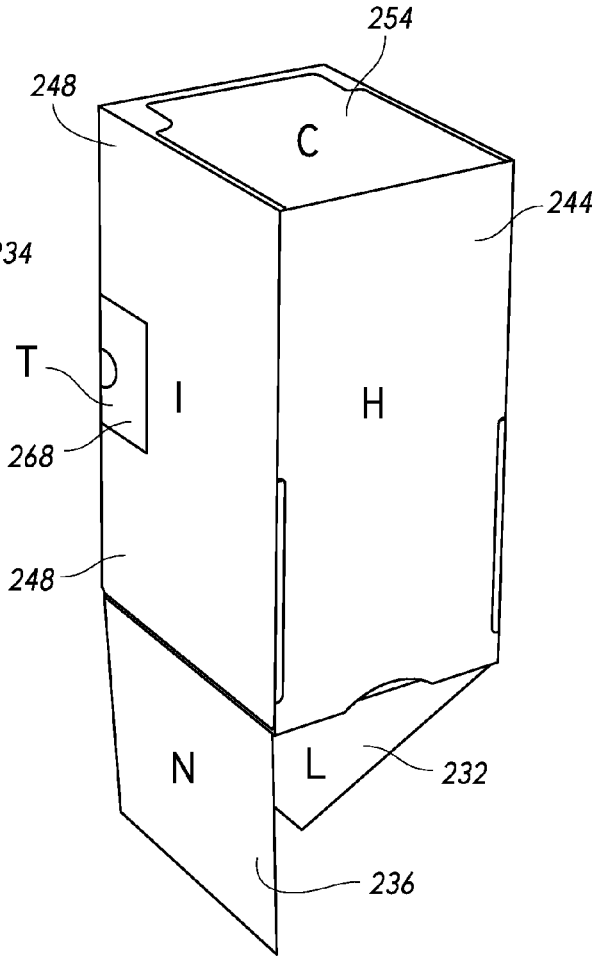
FIG. 27 is a perspective view of the container blank shown in FIG. 21, shown in a sixth operative position.

As FIGS. 24 and 25 show, the container blank 210 is then folded at the fold lines 245, 247, and the rear flap 228 is secured to the rear container body body panel 226 by taping or gluing. The top of the retail ready container is then assembled as shown in FIG. 26 by folding the rear top flap 238 downwardly along the fold line 251 and folding the cover top 254 downwardly so as to overlie the rear top flap 238 and then securing the flaps 238, 254 by folding down the flaps 240, 242 and then taping or gluing.

Figure 28:
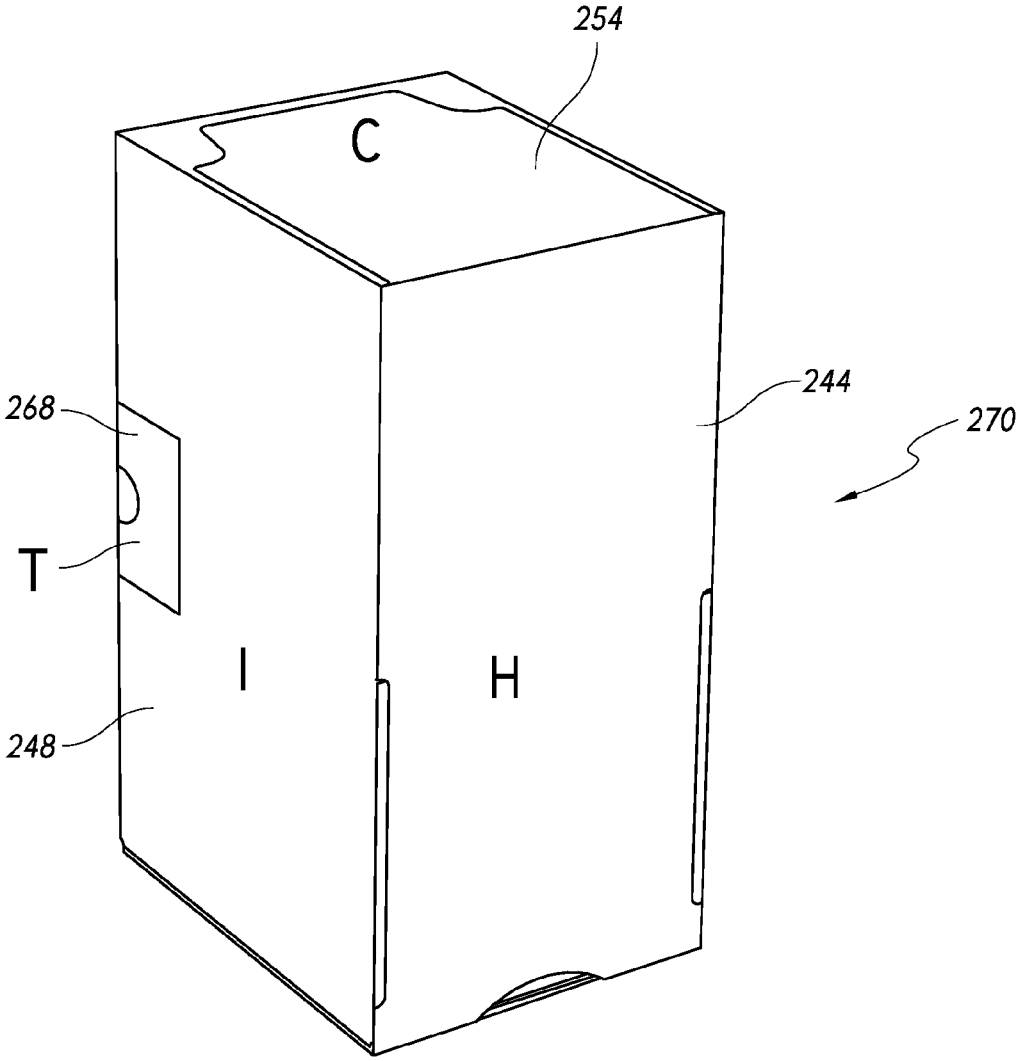
FIG. 28 is a perspective view of the container blank shown in FIG. 21, shown in a seventh operative position.

The bottom of the retail ready container 270 is then assembled by folding the rear and front bottom container flaps 230, 234 inwardly, folding the left bottom container body flap 232 inwardly and then folding the right container body bottom flap 236 inwardly, as is shown in FIG. 28. The flap 236 may be secured to the flap 232 by taping or gluing.

One advantage of the retail ready container 270 is at the foregoing assembly steps may be performed using automated machinery rather than manually, which saves labor costs in comparison to manual assembly.

Figure 29:
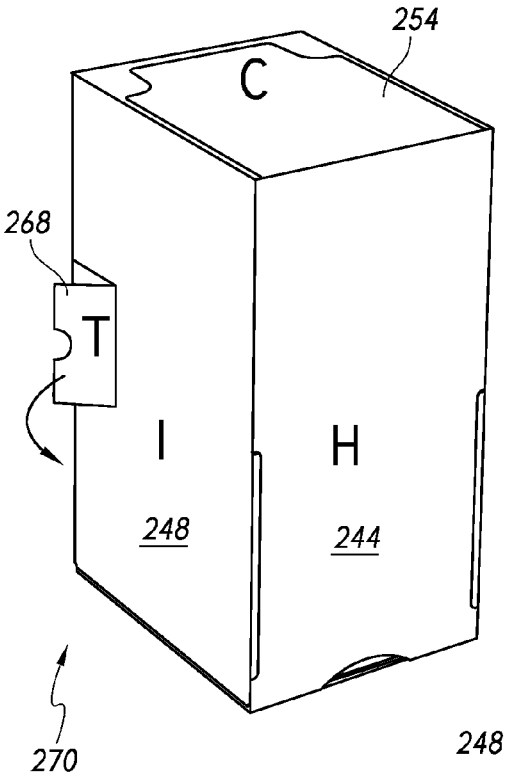
FIG. 29 is a perspective view of a container that is constructed from the container blank shown in FIG. 21, shown in a first operative position.

As may best be visualized in FIG. 29, the protective cover portion 214 of the retail ready container 270 is configured so that the left side cover panel 248 protects at least a portion of the left side container body panel 224 and so that the right side cover panel 246 protects the right container body panel 222 during shipping and transportation. In the preferred embodiment, the respective cover panels 246, 248 have substantially the same height as the container body panels 222, 224, so substantially the entire container body panel 222, 224 is protected. In addition, the cover front panel 244 preferably overlies and protects substantially the entire front face of the front container body panel 220 during shipping and transportation.

Figure 30:
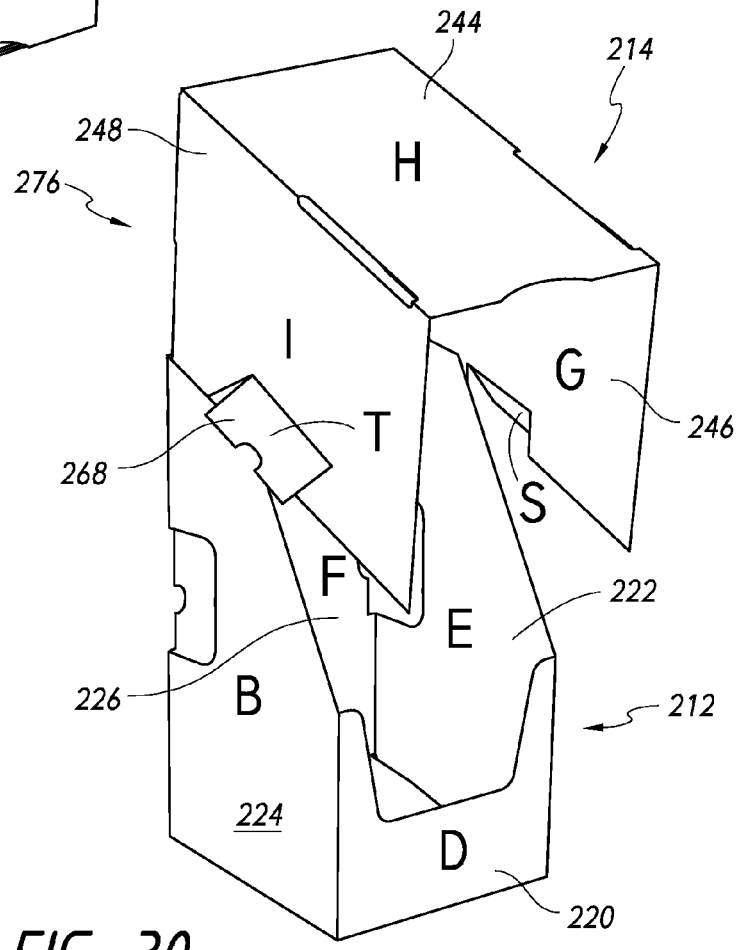
FIG. 30 is a perspective view of the container shown in FIG. 29, shown in a second operative position.

After the retail ready container 270 containing product has been received in a retail establishment, it is prepared for dispensing product by pulling the cover portion 214 upwardly in a pivotal movement, as is best shown in FIG. 29. Tabs 264, 268 may be used to facilitate gripping of the cover portion 214. As this occurs, the frangible attachment between the right side cover panel 246 and the right side container body panel 222 as well as the frangible attachment between the left side cover panel 248 and the left container body panel 224 are at least partially torn. The pivotal movement preferably occurs about an axis that includes pivot points along the common fold line 251 as shown in FIG. 30 along the respective frangible connections 250, 252.

Figure 31:
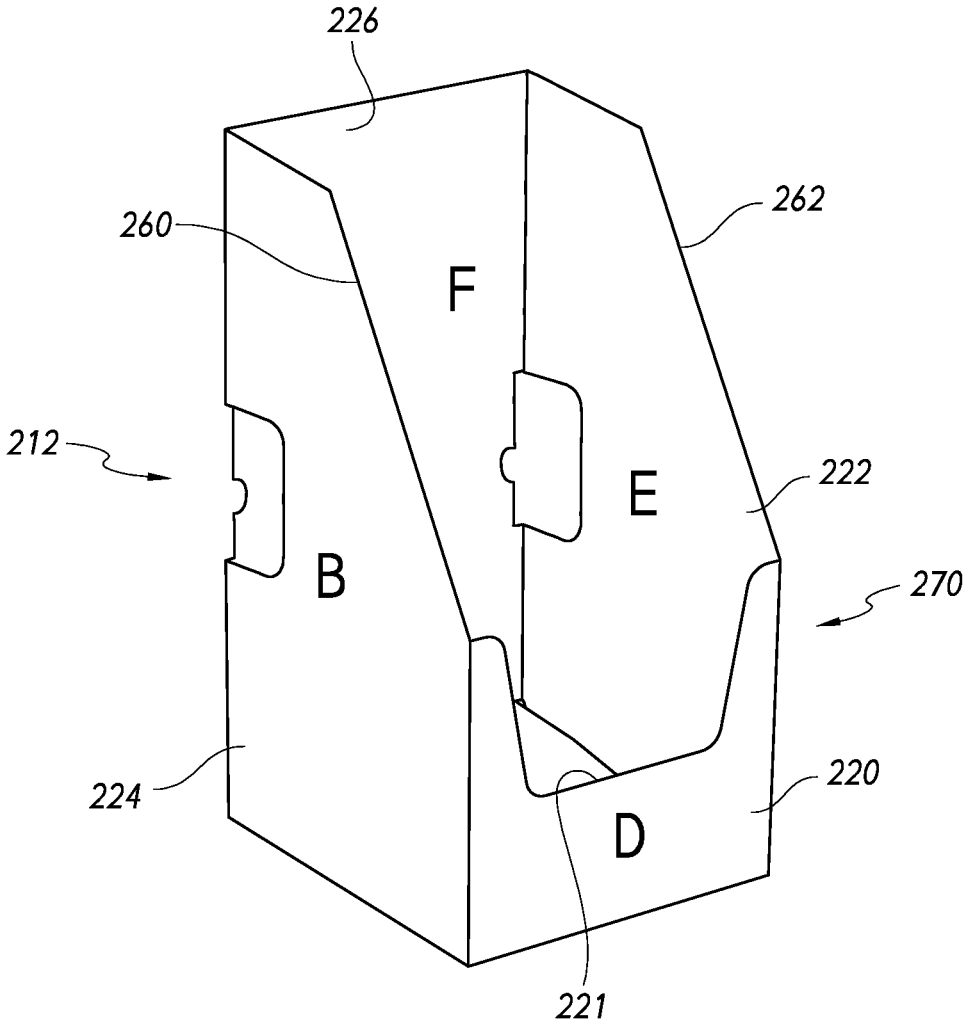
FIG. 31 is a perspective view of the container shown in FIG. 29, shown in a third operative position.

After the cover portion 214 has been completely removed, the retail ready container 270 will have an exposed access opening defined by the profiled upper edge 221 of the container body front panel 220, as is shown in FIG. 31. This allows consumers to more conveniently view and remove product from the retail ready container 270.

Referring now to the FIGS. 32-41, a container blank 310 that is constructed according to a fourth embodiment of the invention includes a container body portion 312 and a cover portion 314. This option shows the front of the tray positioned on the long side rather than the short side.

Container blank 310 is preferably constructed as a single unitary sheet of corrugated fiberboard, preferably the same material described previously with respect to the first embodiment.

The container body portion 312 preferably includes a front panel 320 that has a profiled upper surface 321 defining a recess that facilitates removal of products by a consumer in a retail setting. Container body portion 312 further preferably has a right container body panel 322 that is integral with the front container body panel 320 and joined thereto along a vertically oriented fold line 345. Container body portion 312 also includes a left container body panel 324 that is also integral with the front container body panel 320 and joined thereto along a vertically oriented fold line 347.

Container body portion 312 also includes a rear container body panel 326 that is integral with the right container body panel 322 and joined thereto along a vertically oriented fold line. In addition, a rear container body flap 328 is preferably joined to the left container body panel 324 by a vertically oriented fold line 327.

A rear bottom container body flap 330 and a rear top container body flap 338 are respectively joined to the rear container body panel 326 by horizontally oriented fold lines. A left container body bottom flap 332 is joined to a lower end of the right container body panel 322 by a horizontal fold line 333, and a right container body bottom flap 336 is joined to a lower end of the left container body panel 324 by another horizontal fold line 335 that is preferably substantially aligned with the fold line 333 when the container blank 310 is in the flat configuration shown in FIG. 32.

Figure 32:
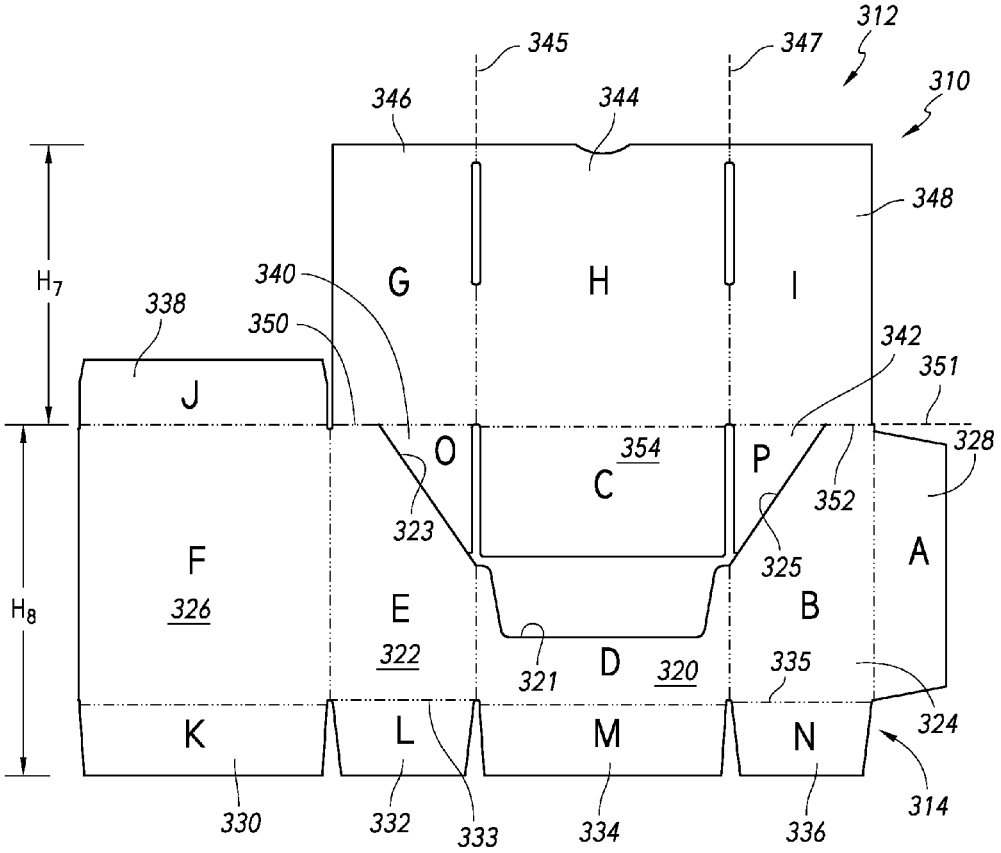
FIG. 32 is a side elevational view of a container blank is constructed according to a fourth embodiment of the invention.

The embodiment of the invention that is shown in FIG. 32 further includes flaps 340, 342 that are similar to the flaps 40, 42 that were present in the first embodiment.

The cover portion 314 includes the right cover panel 346, the left cover panel 348 and a front cover panel 344. The right cover panel 346 is preferably integral with and joined to the front cover panel 344 along a vertically oriented fold line 345 that is preferably substantially aligned with the fold line that is defined between the front container body panel 320 and right container body panel 322. Similarly, the left cover panel 346 is preferably integral with and joined to an opposite side of the front cover panel 344 along a vertically oriented fold line 347 that is preferably substantially aligned with the fold line that is defined between the front container body panel 320 and the left container body panel 324.

The cover top flap 354 is joined to a lower end of the cover front panel 344 along a common fold line 351.

Accordingly, the frangible attachment between the left side cover panel 348 and the left side container body panel 324 and the frangible attachment between the right side cover panel 346 and the right side container body panel 322 are along the common fold line 351. Moreover, the connection between the cover front panel 344 and the cover top flap 354 is along the common fold line 351.

The right side cover panel 346, the cover front panel 344 and the cover left side panel 348 all preferably have a common first height $H_7$, as is shown in FIG. 32. In the preferred embodiment, the right container body panel 322, the left container body panel 324 and the rear container body panel 326 have a common second height $H_8$ that preferably is substantially the same as the first height $H_7$.

As FIG. 32 also shows, the right side container body panel 322 has an upper edge having a first portion 350 that is frangibly joined along the common fold line 351 to the cover right side panel 346 and a second portion 323 that is angled with respect to the first portion 350. Similarly, the left container body panel 324 has an upper edge having a first portion 352 that is frangibly joined to the cover left side panel 348 along the common fold line 351 and a second portion 325 that is angled with respect to the first portion 352.

The second portion 325 of the upper edge of the left side container body panel 324 is preferably substantially symmetrical with respect to the second portion 323 of the upper edge of the right side container body panel 322 along a vertical axis. Moreover, the right side container body panel 322 has a shape that is substantially symmetrical with respect to the left side container body panel 324 along the same vertical axis.

As will be described in greater detail below, the cover portion 314 is constructed and arranged to protect during the shipping and transportation process the surfaces of the retail ready container 370 that are most likely to be within view of consumers in a retail setting, i.e. the finished surfaces of the right side container body panel 322, the left side container body panel 324 and the front container body panel 320.

Figure 33:
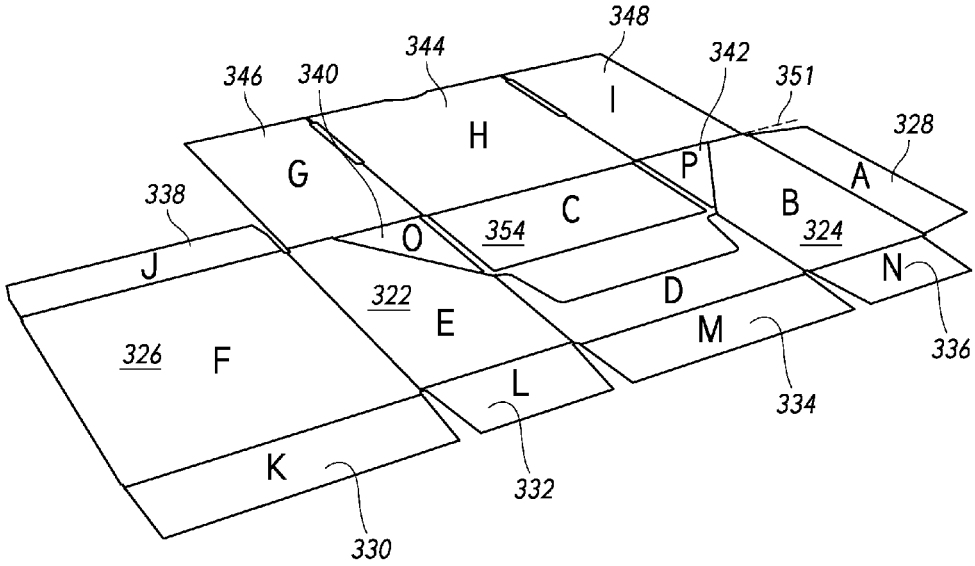
FIG. 33 is a perspective view showing the container blank of FIG. 32 in a first operative position.
Figure 34:
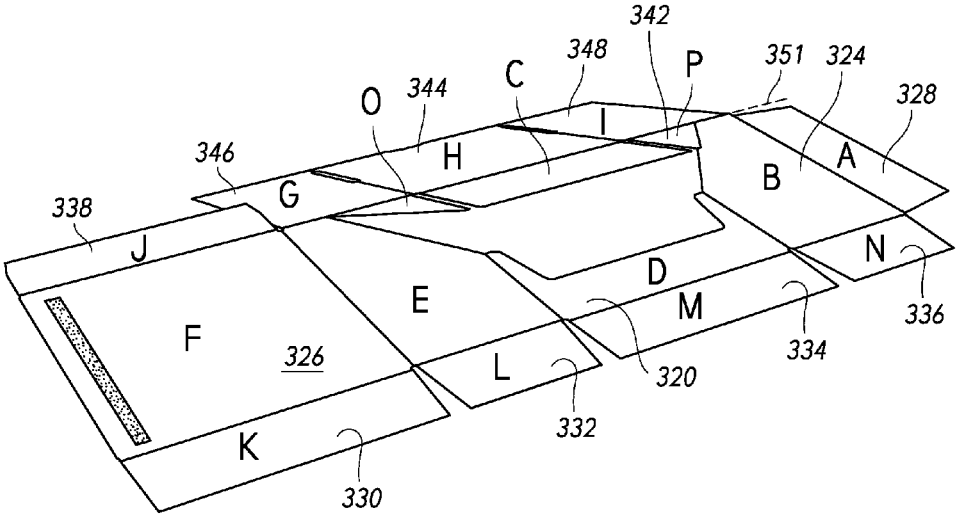
FIG. 34 is a perspective view showing the container blank of FIG. 32 in a second operative position.

Referring now to FIGS. 33 and 34, the preferred method for assembling a retail ready container 370 from the container blank 310 includes a first step of folding the cover portion 314 backwardly along the common fold line 351 until the finished surfaces of the cover front panel 344, the cover right side panel 346 and a cover left side panel 348, which are on the second side 318 of the container blank 310, are opposed to and substantially in contact with the finished surfaces, respectively, of the container body front panel 321, the container body right panel 322 and the container body left panel 324.

Figure 35:
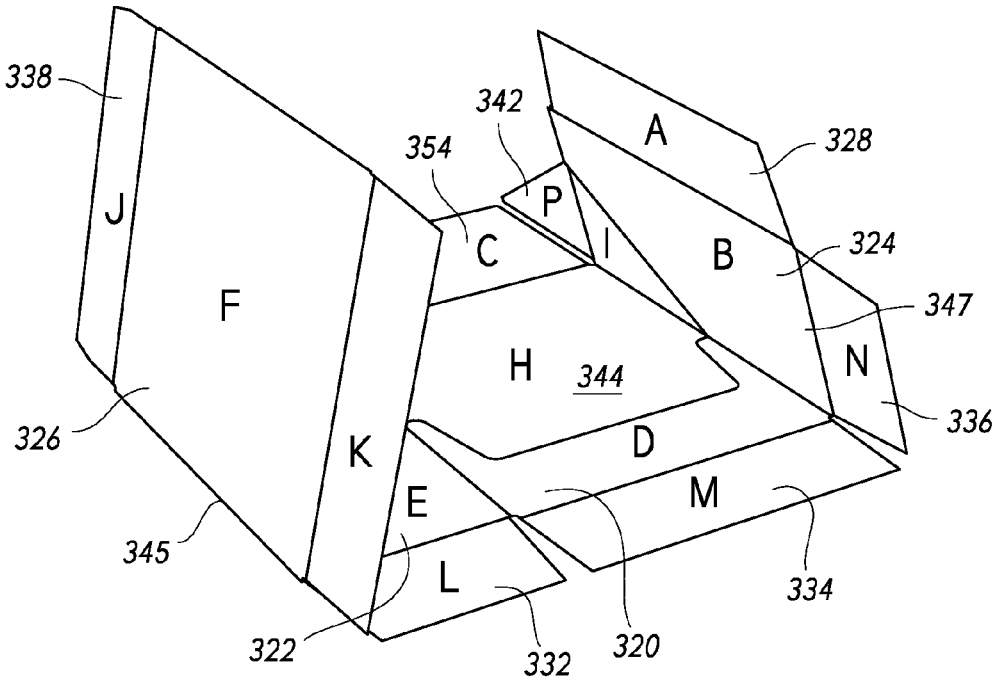
FIG. 35 is a perspective view showing the container blank of FIG. 32 in a third operative position.
Figure 36:
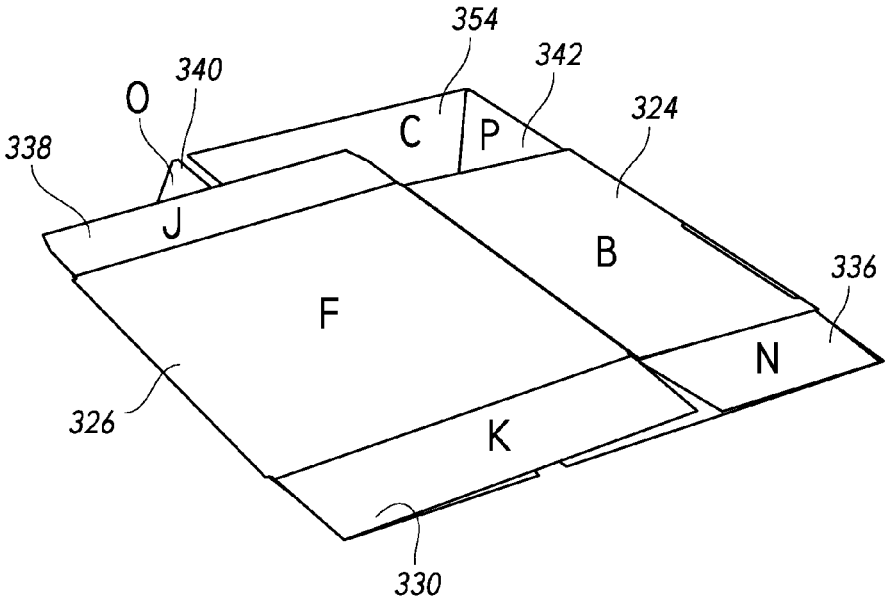
FIG. 36 is a perspective view showing the container blank of FIG. 32 in a fourth operative position.
Figure 37:
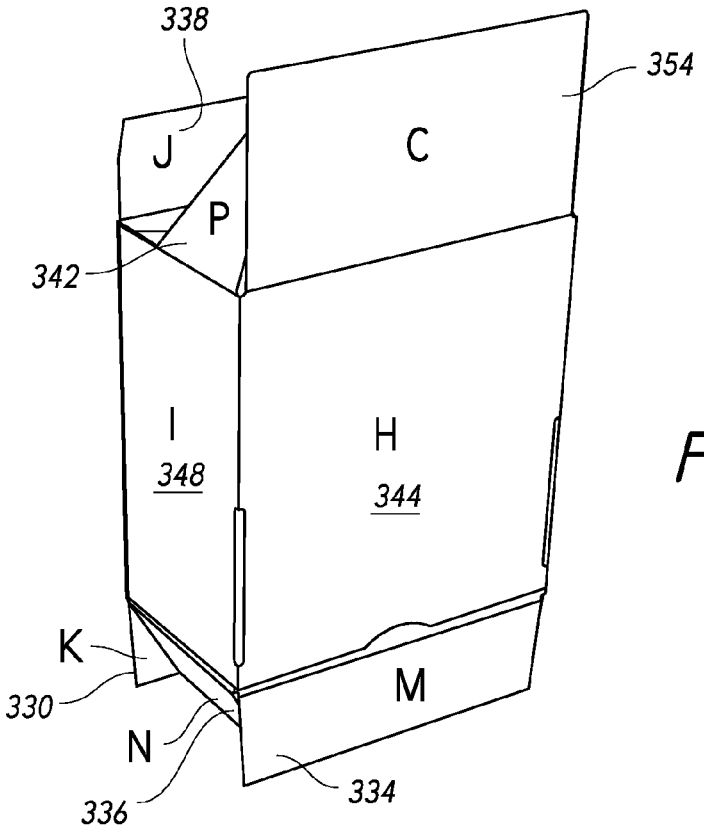
FIG. 37 is a perspective view showing the container blank of FIG. 32 in a fifth operative position.
Figure 38:
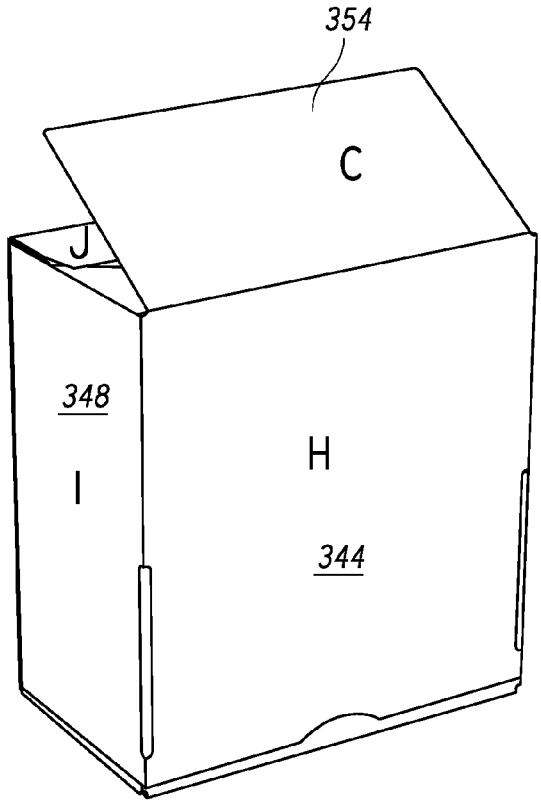
FIG. 38 is a perspective view showing the container blank of FIG. 32 in a sixth operative position.

As FIGS. 35 and 36 show, the container blank 310 is then folded at the fold lines 345, 347, and the rear flap 328 is secured to the rear container body body panel 326 by taping or gluing. The top of the retail ready container is then assembled as shown in FIG. 37 by folding the rear top flap 338 downwardly along the fold line 351 and folding the cover top 354 downwardly so as to overlie the rear top flap 338 and then securing the flaps 338, 354 by taping or gluing.

Figure 39:
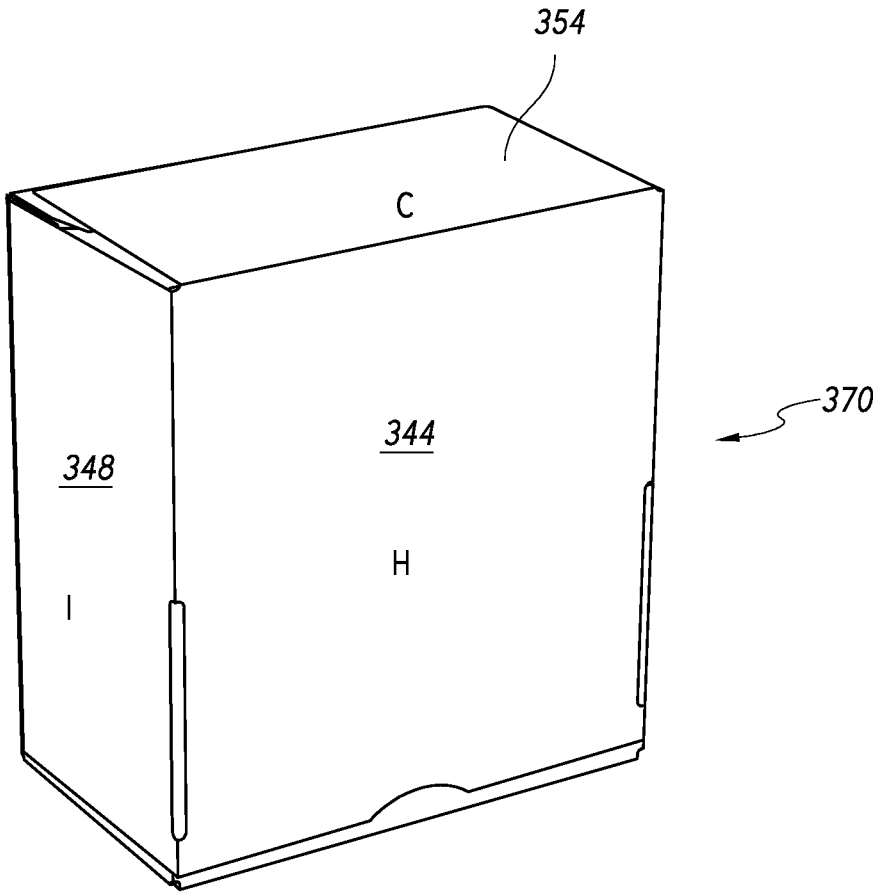
FIG. 39 is a perspective view showing the container blank of FIG. 32 in the seventh operative position.

The bottom of the retail ready container 370 is then assembled by folding the rear and front bottom container flaps 330, 334 inwardly, folding the left bottom container body flap 332 inwardly and then folding the right container body bottom flap 336 inwardly, as is shown in FIG. 39. The flap 336 may be secured to the flap 332 by taping or gluing.

One advantage of the retail ready container 370 is at the foregoing assembly steps may be performed using automated machinery rather than manually, which saves labor costs in comparison to manual assembly.

Figure 40:
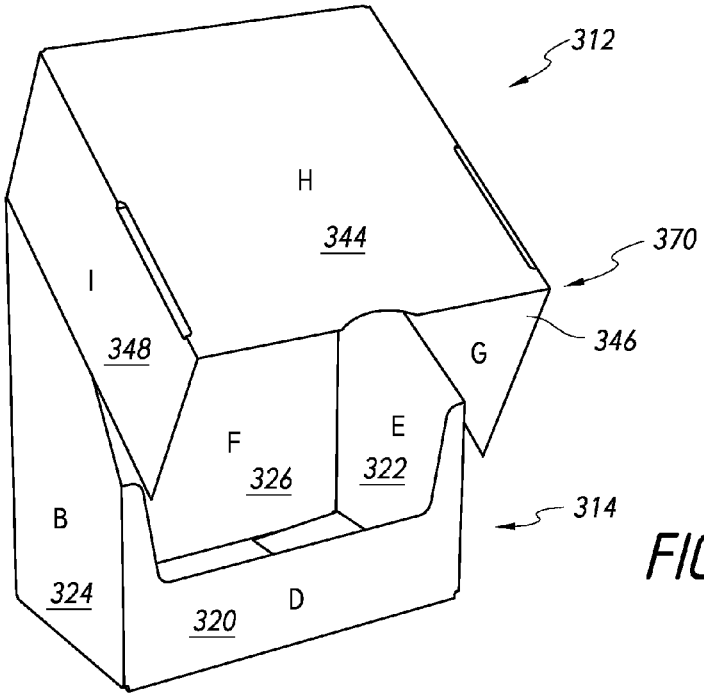
FIG. 40 is a perspective view of a container that is constructed according to the container blank shown in FIG. 32, shown in a first operative position.

As may best be visualized in FIG. 40, the protective cover portion 314 of the retail ready container 370 is configured so that the left side cover panel 348 protects at least a portion of the left side container body panel 324 and so that the right side cover panel 346 protects the right container body panel 322 during shipping and transportation. In the preferred embodiment, the respective cover panels 346, 348 have substantially the same height as the container body panels 322, 324, so substantially the entire container body panel 322, 324 is protected. In addition, the cover front panel 344 preferably overlies and protects substantially the entire front face of the front container body panel 320 during shipping and transportation.

After the retail ready container 370 containing product has been received in a retail establishment, it is prepared for dispensing product by pulling the cover portion 314 upwardly in a pivotal movement, as is best shown in FIG. 40. As this occurs, the frangible attachment between the right side cover panel 346 and the right side container body panel 322 as well as the frangible attachment between the left side cover panel 348 and the left container body panel 324 are at least partially torn. The pivotal movement preferably occurs about an axis that includes pivot points along the common fold line 351 as shown in FIG. 32 along the respective frangible connections 350, 352.

Figure 41:
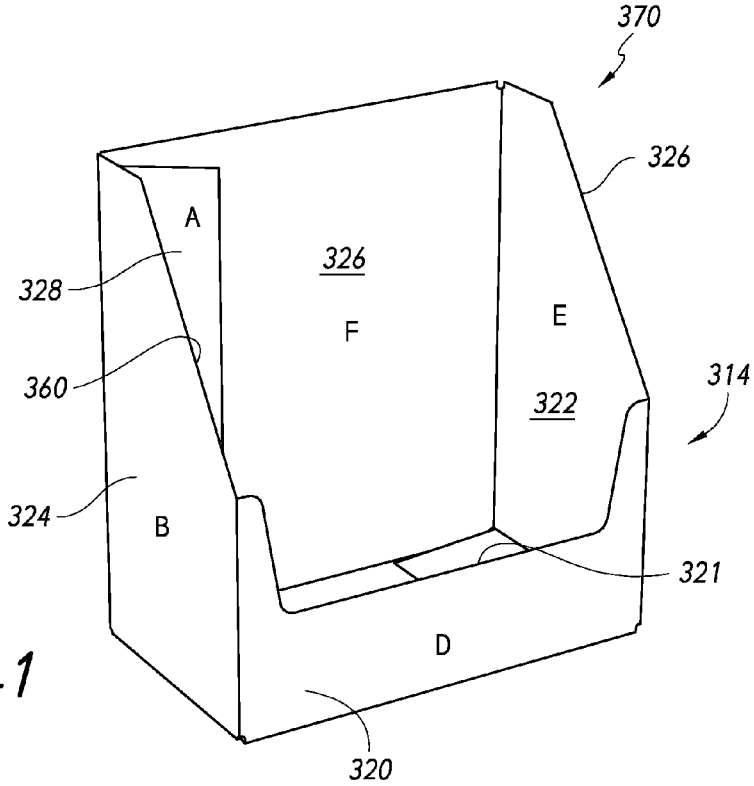
FIG. 41 is a perspective view of the container shown in FIG. 40, with a cover portion removed.

After the cover portion 314 has been completely removed, the retail ready container 370 will have an exposed access opening defined by the profiled upper edge 321 of the container body front panel 320, as is shown in FIG. 41. This allows consumers to more conveniently view and remove product from the retail ready container 30.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A container blank, comprising:

a container body portion comprising a front container body panel, a left side container body panel, a right side container body panel, a rear container body panel and at least one bottom container body panel, and a cover portion comprising a front cover panel, a left side cover panel and a right side cover panel, wherein the left side cover panel is frangibly attached to the left side container body panel and wherein the right side cover panel is frangibly attached to the right side container body panel and wherein the frangible attachment between the left side cover panel and the left side container body panel and the frangible attachment between the right side cover panel and the right side container body panel are along a common fold line.

2. A container blank according to claim 1, wherein the cover has a top flap that is attached to the front cover panel along a fold line that is substantially aligned with the common fold line.

3. A container blank according to claim 1, wherein the front cover panel is attached to the left side cover panel along a first fold line, and wherein the front container body panel is attached to the left side container body panel along a second fold line that is substantially aligned with the first fold line.

4. A container blank according to claim 1, wherein the front cover panel is attached to the right side cover panel along a first fold line, and wherein the front container body panel is attached to the right side container body panel along a second fold line that is substantially aligned with the first fold line.

5. A container blank according to claim 1, wherein the right side cover panel has a first height, and wherein the right side container body panel has a second height that is substantially the same as the first height.

6. A container blank according to claim 1, wherein the right side container body panel has an upper edge having a first portion that is frangibly joined to the right side cover panel and a second portion that is angled with respect to the first portion.

7. A container blank according to claim 6, wherein the left side container body panel has an upper edge having a first portion that is frangibly joined to the left side cover panel and a second portion that is angled with respect to the first portion.

8. A container blank according to claim 7, wherein the second portion of the upper edge of the left side container body panel is substantially symmetrical with respect to the second portion of the upper edge of the right side container body panel along a vertical axis.

9. A container blank according to claim 1, wherein the right side container body panel has a shape that is substantially symmetrical with respect to the left side container body panel along a vertical axis.

10. A retail ready container, comprising:

a container body portion having a front container body panel, a left side container body panel, a right side container body panel, a rear container body panel and at least one bottom container body panel; and a protective cover portion comprising a left side cover panel that is frangibly attached to the left side container body panel and is constructed and arranged to protect at least a portion of the left side container body panel;

a right side cover panel that is frangibly attached to the right side container body panel and is constructed and arranged to protect at least a portion of the right side container body panel; and a front cover panel that is integral with the left and right side cover panels.

11. A retail ready container according to claim 10, wherein the frangible attachment between the left side cover panel and the left side container body panel and the frangible attachment between the right side cover panel and the right side container body panel are substantially parallel and substantially within a common plane.

12. A retail ready container according to claim 11, wherein the cover has a top flap that is attached to the front cover panel along a fold line.

13. A retail ready container according to claim 10, wherein the front cover panel is attached to the left side cover panel along a first fold line, and wherein the front container body panel is attached to the left side container body panel along a second fold line that is substantially parallel and adjacent to the first fold line.

14. A retail ready container according to claim 10, wherein the front cover panel is attached to the right side cover panel along a first fold line, and wherein the front container body panel is attached to the right side container body panel along a second fold line that is substantially parallel and adjacent to the first fold line.

15. A retail ready container according to claim 10, wherein the right side cover panel has a first height, and wherein the right side container body panel has a second height that is substantially the same as the first height.

16. A retail ready container according to claim 10, wherein the right side container body panel has an upper edge having a first portion that is frangibly joined to the right side cover panel and a second portion that is angled with respect to the first portion.

17. A retail ready container according to claim 16, wherein the first portion of the upper edge defines a pivot point about which the protective cover portion pivots when lifted away from the container body portion, and wherein the frangible connection between the first portion of the upper edge and the right side cover panel is at least partially torn when the protective cover portion is lifted.

18. A retail ready container according to claim 10, wherein the left side container body panel has an upper edge having a first portion that is frangibly joined to the left side cover panel and a second portion that is angled with respect to the first portion.

19. A retail ready container according to claim 18, wherein the first portion of the upper edge defines a pivot point about which the protective cover portion pivots when lifted away from the container body portion, and wherein the frangible connection between the first portion of the upper edge and the left side cover panel is at least partially torn when the protective cover portion is lifted.

20. A retail ready container according to claim 18, wherein the second portion of the upper edge of the left side container body panel is substantially symmetrical with respect to the second portion of the upper edge of the right side container body panel along a vertical axis.

21. A retail ready container according to claim 10, wherein the right side container body panel has a shape that is substantially symmetrical with respect to the left side container body panel along a vertical axis.

22. A retail ready container according to claim 10, wherein the container body portion and the protective cover portion are fabricated from a single container blank having a finished side surface and an unfinished side surface, and wherein the finished side surfaces of the left and right side cover panels are positioned so as to be substantially adjacent to and opposed from the respective finished side surfaces of the left and right side container body panels when the retail ready container is assembled.

23. A retail ready container, comprising:

a container body portion and a protective cover portion that are fabricated from a common container blank having a finished side surface and a unfinished side surface;

the container body portion having a front container body panel, a left side container body panel, a right side container body panel, a rear container body panel and at least one bottom container body panel;

the protective cover portion having a left side cover panel, a right side cover panel and a front cover panel that is integral with the left and right side cover panels; and wherein the finished side surfaces of the left and right side cover panels are positioned so as to be substantially adjacent to and opposed from the respective finished side surfaces of the left and right side container body panels when the retail ready container is assembled.

24. A retail ready container according to claim 23, wherein the left side cover panel is frangibly attached to the left side container body panel and the right side cover panel is frangibly attached to the right side container body panel.

25. A retail ready container according to claim 23, wherein the common container blank is corrugated.

26. A retail ready container according to claim 24, wherein the upper edge of the left and right side cover panels define respective pivot points about which the protective cover portion pivots when lifted away from the container body portion.

27. A retail ready container according to claim 26, wherein the respective pivot points are defined at respective portions of the upper edges that are frangibly attached to the respective container body panels.

28. A retail ready container according to claim 26, wherein the frangible attachments are constructed and arranged to at least partially tear when the protective cover portion is lifted away from the container body portion.

29. A retail ready container according to claim 23, wherein the right side cover panel and the left side cover panel have first height that is substantially the same, and wherein the left side container body panel and the right side container body panel both have a second height that is substantially the same as the first height.

30. A container blank, comprising:

a container body portion comprising a front container body panel, a left side container body panel, a right side container body panel, a rear container body panel and at least one bottom container body panel, and a cover portion comprising a front cover panel, a left side cover panel and a right side cover panel, wherein the left side cover panel is frangibly attached to the left side container body panel and wherein the right side cover panel is frangibly attached to the right side container body panel, wherein the right side cover panel has a first height, and wherein the right side container body panel has a second height that is substantially the same as the first height.

31. A retail ready container, comprising:

a container body portion having a front container body panel, a left side container body panel, a right side container body panel, a rear container body panel and at least one bottom container body panel; and a protective cover portion comprising a left side cover panel that is frangibly attached to the left side container body panel and is constructed and arranged to protect at least a portion of the left side container body panel;

a right side cover panel that is frangibly attached to the right side container body panel and is constructed and arranged to protect at least a portion of the right side container body panel; and a front cover panel that is integral with the left and right side cover panels, wherein the right side cover panel has a first height, and wherein the right side container body panel has a second height that is substantially the same as the first height.

32. A retail ready container, comprising:

a container body portion having a front container body panel, a left side container body panel, a right side container body panel, a rear container body panel and at least one bottom container body panel; and a protective cover portion comprising a left side cover panel that is frangibly attached to the left side container body panel and is constructed and arranged to protect at least a portion of the left side container body panel;

a right side cover panel that is frangibly attached to the right side container body panel and is constructed and arranged to protect at least a portion of the right side container body panel; and a front cover panel that is integral with the left and right side cover panels, wherein the right side container body panel has an upper edge having a first portion that is frangibly joined to the right side cover panel and a second portion, wherein the first portion of the upper edge defines a pivot point about which the protective cover portion pivots when lifted away from the container body portion, and wherein the frangible connection between the first portion of the upper edge and the right side cover panel is at least partially torn when the protective cover portion is lifted.

33. A retail ready container, comprising:

a container body portion having a front container body panel, a left side container body panel, a right side container body panel, a rear container body panel and at least one bottom container body panel; and a protective cover portion comprising a left side cover panel that is frangibly attached to the left side container body panel and is constructed and arranged to protect at least a portion of the left side container body panel;

a right side cover panel that is frangibly attached to the right side container body panel and is constructed and arranged to protect at least a portion of the right side container body panel; and a front cover panel that is integral with the left and right side cover panels, wherein the left side container body panel has an upper edge having a first portion that is frangibly joined to the left side cover panel and a second portion, wherein the first portion of the upper edge defines a pivot point about which the protective cover portion pivots when lifted away from the container body portion, and wherein the frangible connection between the first portion of the upper edge and the left side cover panel is at least partially torn when the protective cover portion is lifted.

34. A retail ready container according to claim 10, wherein the front cover panel is constructed and arranged to protect at least a portion of the front container body panel.

* * * * *